US011213960B2

(12) United States Patent
Ambielli

(10) Patent No.: US 11,213,960 B2
(45) Date of Patent: Jan. 4, 2022

(54) MULTI-TOOL AND STORAGE DEVICE

(71) Applicant: John Ambielli, Mills River, NC (US)

(72) Inventor: John Ambielli, Mills River, NC (US)

( * ) Notice: Subject to any disclaimer, the term of this patent is extended or adjusted under 35 U.S.C. 154(b) by 294 days.

(21) Appl. No.: 16/283,055

(22) Filed: Feb. 22, 2019

(65) Prior Publication Data

US 2020/0086513 A1 Mar. 19, 2020

Related U.S. Application Data

(60) Provisional application No. 62/732,129, filed on Sep. 17, 2018.

(51) Int. Cl.
*B26B 11/00* (2006.01)
*B25F 1/00* (2006.01)
(Continued)

(52) U.S. Cl.
CPC ..... *B26B 11/001* (2013.01); *A45C 7/0054* (2013.01); *B25F 1/006* (2013.01);
(Continued)

(58) Field of Classification Search
CPC ..... B25F 1/00; B25F 1/02; B25F 1/04; B25F 1/006; B26B 11/00; B26B 11/001;
(Continued)

(56) References Cited

U.S. PATENT DOCUMENTS 4,035,888 A 7/1977 Romagnolo
4,908,947 A * 3/1990 Schaub ..... B26B 11/001 30/155
(Continued)

FOREIGN PATENT DOCUMENTS

CN 101836538 A 9/2010
CN 104942319 A 9/2015
(Continued)

OTHER PUBLICATIONS

Jan. 28, 2020 International Search Report issued in International Patent Application No. PCT/US19/51509.
(Continued)

*Primary Examiner* — David B. Thomas

(74) *Attorney, Agent, or Firm* — Oliff PLC; R. Brian Drozd

(57) ABSTRACT

Multi-tool devices and methods of customizing multi-tool devices in a web-based ordering system are provided. One embodiment of a multi-tool device includes a plurality of compartments, wherein each compartment is configured to house one or more attached tools, one or more removable tools, and/or one or more storage ports. Each compartment includes a moveable portion that is configured to be moveable with respect to the other portions. The multi-tool device further includes at least one pin configured to connect the plurality of compartments together. Each of the moveable portions of the compartments is configured to move between a storage position and a deployed position. When the moveable portions are arranged in their respective storage positions, an outer surface of the multi-tool device has a disk shape, an ellipsoid shape, a truncated ellipsoid shape, a spheroid shape, a truncated spheroid shape, a sphere shape, a truncated sphere shape, an ovoid shape, or a truncated ovoid shape.

19 Claims, 27 Drawing Sheets

(51) Int. Cl.

| | |
|---|---|
| ***A45C 7/00*** | (2006.01) |
| ***B25F 1/04*** | (2006.01) |
| ***A45C 13/00*** | (2006.01) |
| ***A45C 5/08*** | (2006.01) |

(52) U.S. Cl.
CPC ..... *B25F 1/04* (2013.01); *B26B 11/008* (2013.01); *A45C 5/08* (2013.01); *A45C 13/001* (2013.01)

(58) Field of Classification Search
CPC ..... B26B 11/008; A45C 7/0054; A45C 5/08; A45C 13/001; G04F 47/00; G06F 3/0488
See application file for complete search history.

(56) References Cited

U.S. PATENT DOCUMENTS

| | | | | |
|---|---|---|---|---|
| 5,299,477 | A | 4/1994 | Miyajima | |
| 6,185,771 | B1 | 2/2001 | Trusty, Sr. | |
| 8,176,814 | B1 | 5/2012 | Bernstein et al. | |
| 8,402,583 | B1 | 3/2013 | Bebber | |
| 9,289,891 | B1 | 3/2016 | Ragner | |
| D897,183 | S * | 9/2020 | Hancock | B25F 1/003 D8/105 |
| 10,836,022 | B2 * | 11/2020 | Winefordner | B25H 3/006 |
| 10,884,380 | B2 * | 1/2021 | Hancock | G04B 37/12 |
| 2004/0016058 | A1 | 1/2004 | Gardiner et al. | |
| 2005/0081302 | A1 | 4/2005 | Elsener | |
| 2007/0056117 | A1 | 3/2007 | Gardiner et al. | |
| 2009/0229628 | A1 | 9/2009 | Slattery et al. | |
| 2009/0265860 | A1 | 10/2009 | Barber et al. | |
| 2009/0283428 | A1 * | 11/2009 | Adamany | B25B 27/0071 206/223 |
| 2010/0050697 | A1 | 3/2010 | Barry | |
| 2010/0199438 | A1 | 8/2010 | Slattery et al. | |
| 2011/0023238 | A1 | 2/2011 | Orzeck et al. | |
| 2011/0136555 | A1 | 6/2011 | Ramies et al. | |
| 2014/0102262 | A1 | 4/2014 | Johnson et al. | |
| 2014/0237877 | A1 | 8/2014 | Silver | |
| 2015/0183101 | A9 | 7/2015 | Davis | |
| 2015/0280406 | A1 | 10/2015 | Anderson et al. | |
| 2016/0046014 | A1 | 2/2016 | Shine, III | |
| 2016/0270577 | A1 * | 9/2016 | Lekic | A47G 25/74 |
| 2016/0354910 | A1 | 12/2016 | Siegel et al. | |
| 2017/0042307 | A1 | 2/2017 | Blunt | |
| 2018/0303155 | A1 * | 10/2018 | Criss | B25F 1/003 |

FOREIGN PATENT DOCUMENTS

| | | | |
|---|---|---|---|
| CN | 106694147 | A | 5/2017 |
| DE | 000004445363 | A1 | 7/1995 |
| DE | 000004438525 | A1 | 5/1996 |
| DE | 102006013436 | A1 | 9/2007 |
| EP | 0 497 983 | A1 | 8/1992 |
| EP | 2 552 654 | A1 | 2/2013 |
| FR | 2707538 | A1 | 1/1995 |
| WO | 88/009332 | A1 | 12/1988 |
| WO | 92/001522 | A1 | 2/1992 |
| WO | 2014/117206 | A1 | 8/2014 |
| WO | 2015/163923 | A1 | 10/2015 |
| WO | 2017/064901 | A1 | 4/2017 |

OTHER PUBLICATIONS

Jan. 28, 2020 Written Opinion issued in International Patent Application No. PCT/US19/51509.

Mar. 9, 2021 International Preliminary Report on Patentability issued in International Patent Application No. PCT/US2019/051509.

* cited by examiner

MULTI-TOOL AND STORAGE DEVICE

CROSS-REFERENCE TO RELATED APPLICATION

The present application claims the benefit of U.S. Provisional Application No. 62/732,129, filed Sep. 17, 2018.

BACKGROUND

When individuals go out in public, they often need to carry various items with them. Women usually carry a variety of items within purses, while men typically carry items in the pockets of their pants, shorts, jackets, blazers, etc. Items normally carried on an individual may include, for instance, pocketknives, multi-tool devices, pill cases, mint cases, wallets, flashlights, nail clippers, cell phones, back-up cell phone batteries with or without charging cords, flash/thumb drives, lighters, money clips, change purses, etc. Sometimes, individuals may carry all of their "everyday carry" (EDC) items loose in their pockets. Other times, individuals may place their EDC items in small containers, such as within small purses, tins (e.g., Altoids™ tins), etc.

Pocketknives and other similar types of tools are useful devices for allowing a user to perform a number of different types of actions. For example, some pocketknives may include multiple sizes and types of knife blades, corkscrews, files, and other utility tools for cutting, opening bottles, filing finger nails, etc. However, some of these devices that include multiple tools may be bulky and may have sharp or jagged edges. Therefore, some of these multi-tool devices in use today cannot easily be stored in the owner's pocket without snagging the material on the inside of the owner's pockets. Also, the full collection of various EDC items will often make the user's pockets too bulky, which is both unsightly and uncomfortable.

SUMMARY

The present disclosure describes various embodiments of multi-tool devices having a variety of tools. One embodiment of a multi-tool device includes a plurality of compartments, wherein each compartment is configured to house one or more attached tools, one or more removable tools, and/or one or more storage ports. Each compartment includes a moveable portion that is configured to be moveable with respect to the other portions. The multi-tool device further includes at least one pin configured to connect the plurality of compartments together. Each of the moveable portions of the compartments is configured to move between a storage position and a deployed position. When the moveable portions are arranged in their respective storage positions, an outer surface of the multi-tool device has a disk shape, an ellipsoid shape, a truncated ellipsoid shape, a spheroid (oblate or prolate) shape, a truncated spheroid (oblate or prolate) shape, a sphere shape, a truncated sphere shape, an ovoid shape, or a truncated ovoid shape.

The present disclosure further describes methods of customizing a multi-tool device on a website using a web-based ordering system. According to one embodiment, a non-transitory computer-readable medium of a network-based server configured to enable a processor to execute a number of software steps is provided. The non-transitory computer-readable medium enables the processor to receive an order request from a user at a remote source, wherein the order request includes specifications for constructing a multi-tool device having a plurality of layers. The computer-readable medium further enables the user to select a plurality of tools to be combined into the multi-tool device to be constructed and enables the user to select a layer where each of the plurality of selected tools is to be housed. Each of the plurality of tools includes a moveable portion configured to move with respect to the other tools when the multi-tool device is constructed.

DETAILED DESCRIPTION OF EMBODIMENTS

Figure 1:
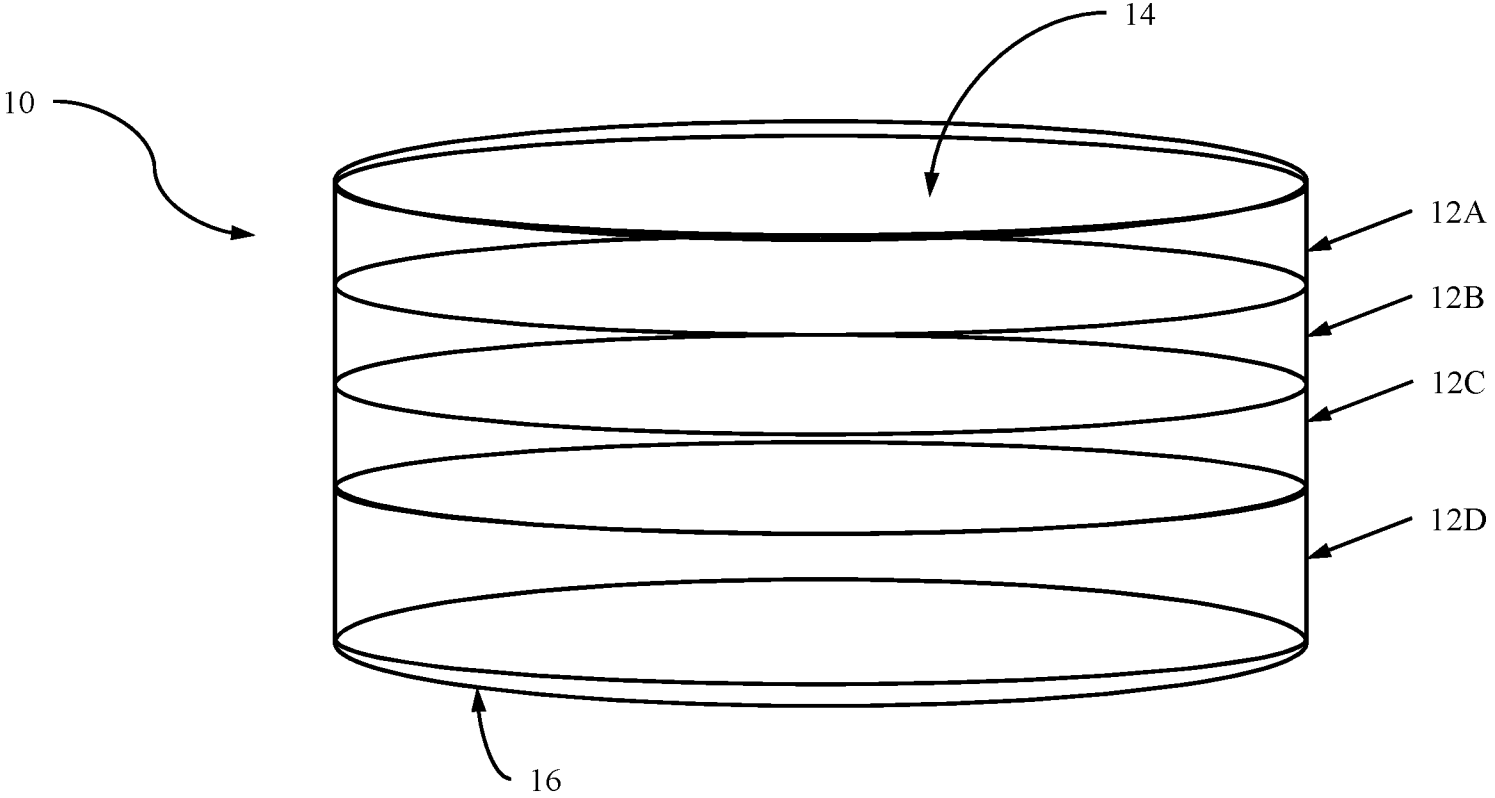
FIG. 1 is a side view of a disk-shaped multi-tool device according to one embodiment of the present disclosure.

The device of the present disclosure is a small (pocket-sized or slightly larger) disc-shaped or ellipsoid-shaped accessory that seeks to integrate or combine into one comfortable unit many of the EDC items a person might normally carry. It utilizes a combination of three main features: 1) attached tools (such as a folding pocket knife) that are deployed by various methods, such as by manually pulling the tool out, flicking the wrist, fully spring-assisted, pressing or sliding a button or switch, etc., 2) removable tools that can be physically separated from the rest of the tool, and 3) ports or pocket for the user to store various objects (such as pills, breath mints, gum, currency bills, coins, credit cards, driver's licenses, business cards, lighters, flashlights, nail clippers, other small multi-tools, etc.).

The device described in the present disclosure may have some of the features of conventional multi-tool devices. However, instead of having edges that may snag the material on the inside of a user's pocket (or in a sheath worn on user's belt, or in user's backpack or other piece of luggage, including a purse, messenger bag, briefcase, laptop bag, carry-on luggage, pull-behind, wheeled luggage or similar), the housing of the device described herein may have an overall smooth surface when the tools are in a storage position. Thus, the outer surfaces of the various tools, when combined, form a structure that is intended to prevent the snagging of material and will be comfortable in the user's pocket. The housing of the device, when the tools are in their storage position, may be disc-shaped, ellipsoid-shaped, or other similar shape.

Another aspect of the multi-tool device of the present disclosure is that customers will be able to "build their own" custom version that would include features and tools that the customer desires. Thus, this device overcomes one of the problems of the current multi-tool market, where customers may have to wait for the next model to come out, possibly after complaining for months or years that the tool does not have certain things that the customer may want, or the current model contains tools that the customer does not want or need.

In some embodiments, the "build your own" concept may be associated with a website where an individual can choose various options and features, as well as a wide variety of materials and designs of the outer casing. In this case, when the customer has placed an order online to customize how they wish their multi-tool device to be designed, the website can be configured to provide pictures showing how the selected tools can be laid out in the tool package. For instance, certain devices or compartments that may normally be accessible from the top can be placed in a top layer. Tools that are normally accessed in a side to side manner may be placed in middle layers.

The website may also give a price for the customer, based on the number and types of tools selected. When the customer decides to purchase the custom-designed tool and pays for the tool, the tool can then be constructed. Once the order is placed, the website may provide the specifications of the device to a manufacturer, which can then build the tool for the customer.

Current multi-tool manufactures include Leatherman, Gerber, Victorinox/Wenger/Swiss Army, CRKT, SOG, Bear and Sons, and others. Additionally, there are some manufacturers of small keychain type single-piece multi-tools, such as Geekey, MyKee, MSTRKey, etc.

One goal of the present application is to provide a multi-tool device that is custom built based on the customer's selections. Also, the tool can be configured in a rounded modular compartment that is comfortable when placed in the user's pocket. The tool may be any size, based on the number of tools selected, but may be placed in a compact housing to reduce bulkiness.

Figure 2:
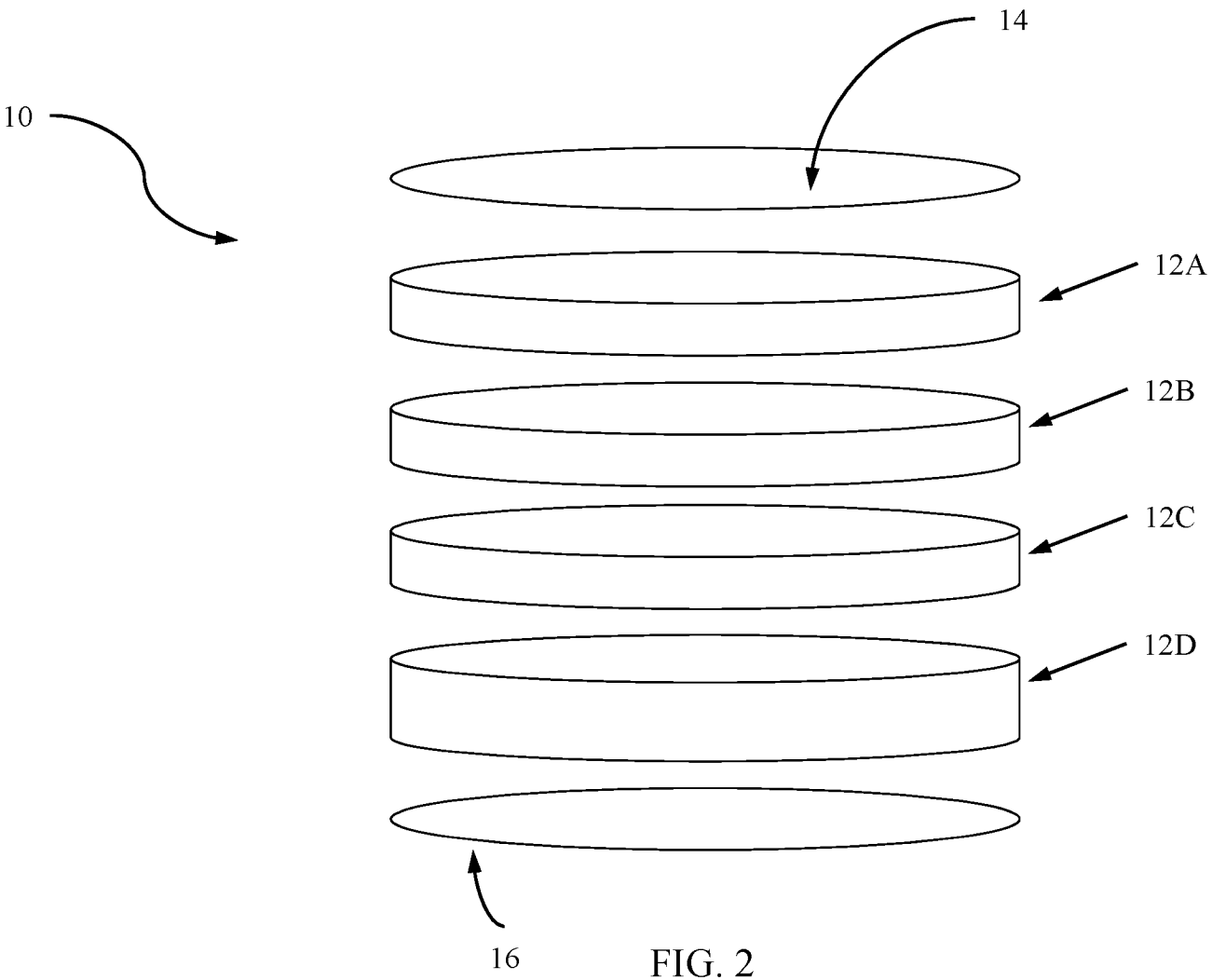
FIG. 2 is an exploded view of the disk-shaped multi-tool device of FIG. 1.

FIG. 1 is a side view of a first embodiment of a multi-tool device 10. In this embodiment, the multi-tool device 10 includes a disk-shaped housing. FIG. 2 is an exploded view of the disk-shaped multi-tool device 10. FIGS. 1 and 2 do not show actual tools, but merely shows a representation of how the layers or compartments are stacked on top of each other. Each layer or compartment may represent the location where one or more tools or other useful items may be stored. Also, the representation of the multi-tool device 10 does not particularly show how each tool can be deployed. These details are described in more detail below.

The multi-tool device 10 includes a number of layers 12A, 12B, 12C, 12D having different thicknesses depending on the type of tool or compartment of each layer. It should be noted that the device 10 may have any number of layers 12, based on the number of tools or compartments that are included and/or selected by the user when the device is being customized. Also, the device 10 includes a top surface 14 and a bottom surface 16.

Figure 3:
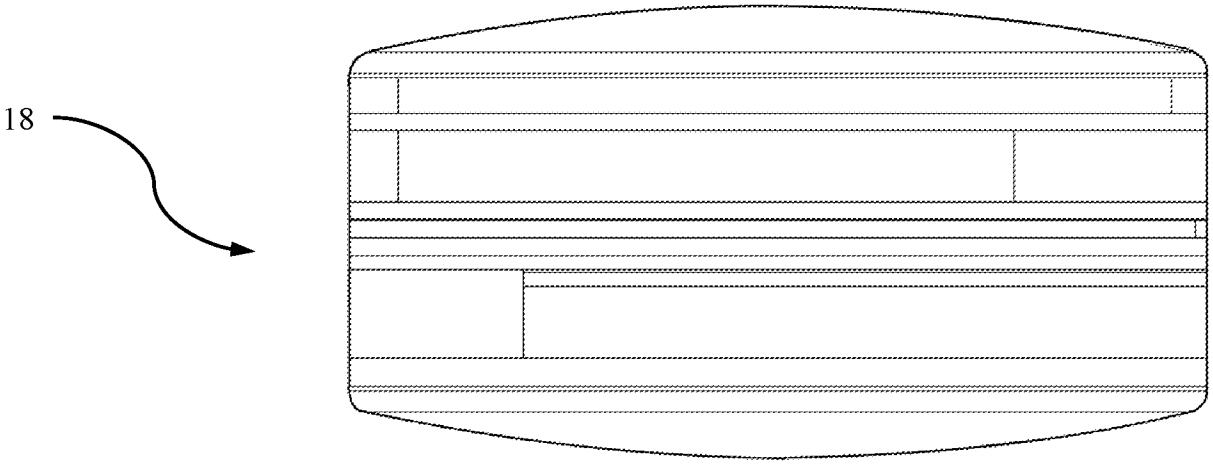
FIG. 3 is a side view of a multi-tool device having a truncated spheroid shape, according to one embodiment of the present disclosure.

FIG. 3 is a side view of a second embodiment of a multi-tool device 18. In this embodiment, the multi-tool device 18 includes a truncated spheroid shape. As shown in FIG. 3, the truncated spheroid shape has truncated end surfaces, whereby the sides are vertical. Other truncated spheroid shapes may include rounded side walls, but flat top and bottom surfaces, or, in other words, truncated at the top and bottom. A third shape may include a sphere or truncated sphere. In some embodiments, parts of the device 10, 18 may include some sides that are flat.

Therefore, the overall shape of the device, when the tools are housed within the housing, may be a disk, an ellipsoid, an ellipsoid with truncated top/bottom surfaces, an ellipsoid with truncated side surfaces, a spheroid, a spheroid with truncated top/bottom surfaces, a spheroid with truncated side surfaces, a sphere, a sphere with truncated top/bottom surfaces, a sphere with truncated side surfaces, an ovoid, an ovoid with truncated top and/or bottom surfaces, or any combination of these shapes. Generally, the shape of the body or housing of the tools 10, 18 will have few, if any, sharp edges so as to minimize the possibility that a user can get cut from the housing and to maximize the comfort of the tools 10, 18 when stored in the user's pocket.

Figure 4:
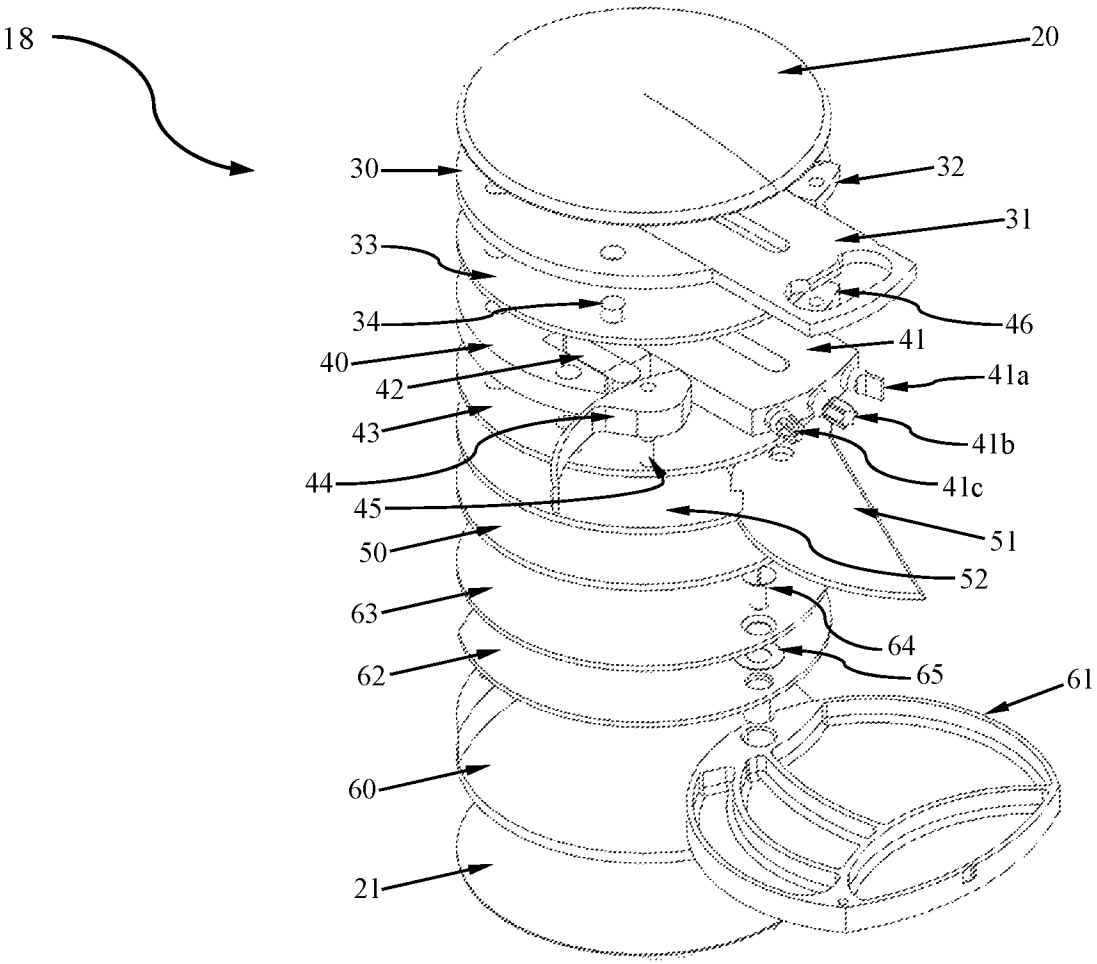
FIG. 4 is an exploded view of the multi-tool device of FIG. 3.

FIG. 4 is an exploded view of the multi-tool device 18 according to one exemplary embodiment. Of course, in other embodiments, a user may wish to select different tools and select different layers in which the tools are assembled. Therefore, FIG. 4 merely represents a single arrangement among thousands of possible arrangements.

In this example, the multi-tool device 18 includes a top cover 20 and a bottom shell 21, which sandwich a number of layers. As shown in the illustrated embodiment, the device 18 includes a bottle opener receiver 30, a bottle opener tool 31, a bottle opener release button 32, a bottle opener base plate 33, and a bottle opener guide pin 34. The bottle opener tool 31 is able to slide into the receiver 30 in a stored state and can slide outward beyond the side walls of the device 18 to deploy the tool 31 and allow the user to use the tool 31 as needed. The receiver 30 may be firmly connected to the base plate 33 by one or more pins 34, whereby the receiver 30, plate 33, and pins constitute a number of stationary elements of the tool 18. The bottle opener tool 31, in this example, constitutes a moveable component that can be moved away from the stationary elements during use.

The multi-tool device 18 further includes a driver set receiver 40 and a driver set tool 41. The driver set tool 41 includes a flat head bit 41*a*, a Torx head bit 41*b*, and a Phillips head bit 41*c*. Along with this set is a driver set latch tensioner 42, a driver set latch/cover 44, a driver set guide pin 45, and a driver set release button 46. The driver set tool 41 may be concealed behind the latch/cover 44 during storage, but may be deployed when a user opens the latch/cover 44.

Also, the multi-tool device 18 includes a blade base plate 50, a blade 51, and a blade receiver 52. The blade 51 can be concealed during storage and can be locked in a useable position by the blade receiver 52 when it is deployed.

The multi-tool device 18 also includes a pill case receiver 60, a pill case 61, a pill case pivoting cover 62, a pill case top plate 63, a pill case screw 64, and a pill case washer 65. The pill case 61 may include any suitable design with any number of compartments for holding pills, coins, or other small objects. The pill case 61 can be deployed by pivoting the device about a pivot pin or the pill case screw 64 pivotably attaching the pill case 61 with the top plate 63, pivoting cover 62, and receiver 60.

In this figure, various types of deployment mechanisms are illustrated as an example of possible options that a user can select during an ordering process. Some deployment mechanisms may include a slide-out feature, where the tool can be slid from a stored position within the housing of the device 18 to a deployed position where the tool can be used. Other deployment mechanisms may be spring-assisted to deploy the tools. Other deployment mechanisms may include pivot pins in which a tool is pivoted about the pivot pin from a stored position to a deployed position. Still other deployment mechanisms may include doors or covers that can be opened by various means to allow access to the tool or compartment. These and other deployment mechanisms can be selected as options by the customer, and are described in more detail below.

As shown in FIGS. 1-4, the multi-tool devices 10, 18 include a number of tools, which may be placed in one or more layers. Tools in each layer may be accessed in a number of ways. For example, some tools can be deployed using a flick of the wrist, causing the tool to pivot from a pivot point on the device and lock in place. When the user if finished using the tool, the tool can then be pushed back into the body of the housing. The tool may include one or more pivot points from which each tool can be deployed. The pivoting mechanisms may include pins, screws, etc.

The layers of the devices 10, 18 are connected together in one package. The connection between layers, to keep the stationary parts of the layers in place, may include pivot pins, connection pins, glue, screws, rivets, or other connection elements. Thus, the stationary parts of each layer remain steady with respect to the overall housing of the device, while moveable parts of the layers may be moved during deployment of the respective tools.

In other embodiments, some tools may be removable from the housing. A locking mechanism may be used to keep the tool in place within the housing when not in use, but may be removed by the user by using a finger or finger nail to pry a corner of the tool from the housing of the tool. The tools can be held in place in the stored position by an internal magnet or spring-loaded push latch (as seen in some furniture drawers or cabinet doors/drawers). The individual tools could also be held by mechanical ball-catch mechanisms.

In some embodiments, some tools may be deployed using a spring-type action, similar to a switchblade action (either a pivot out or straight out (i.e., out the front)). The device can also be configured with the option to spring-assist the return of the tool to the body creating a spring-assisted "out, use, return" action.

Figure 5A:
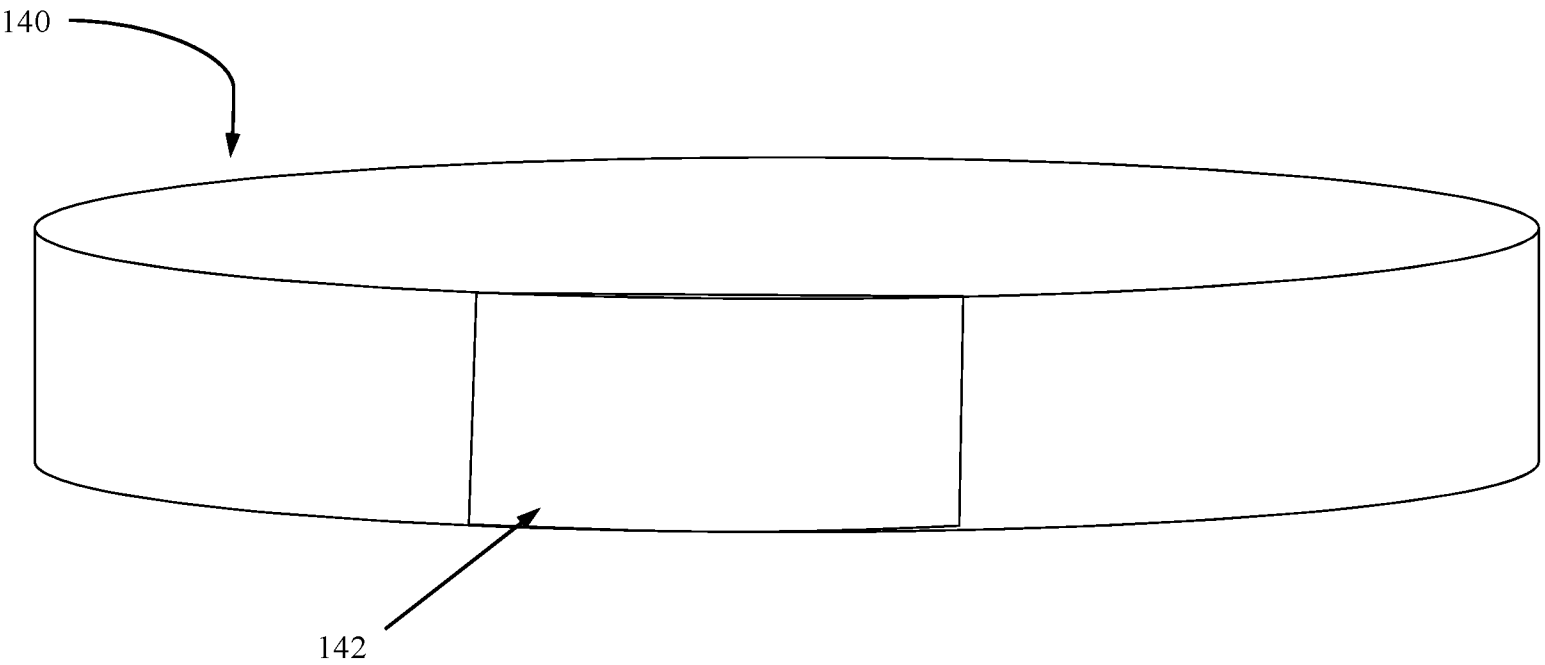
FIG. 5A is a side view of a layer of a multi-tool device having a slider door in a closed position, according to one embodiment.
Figure 5B:
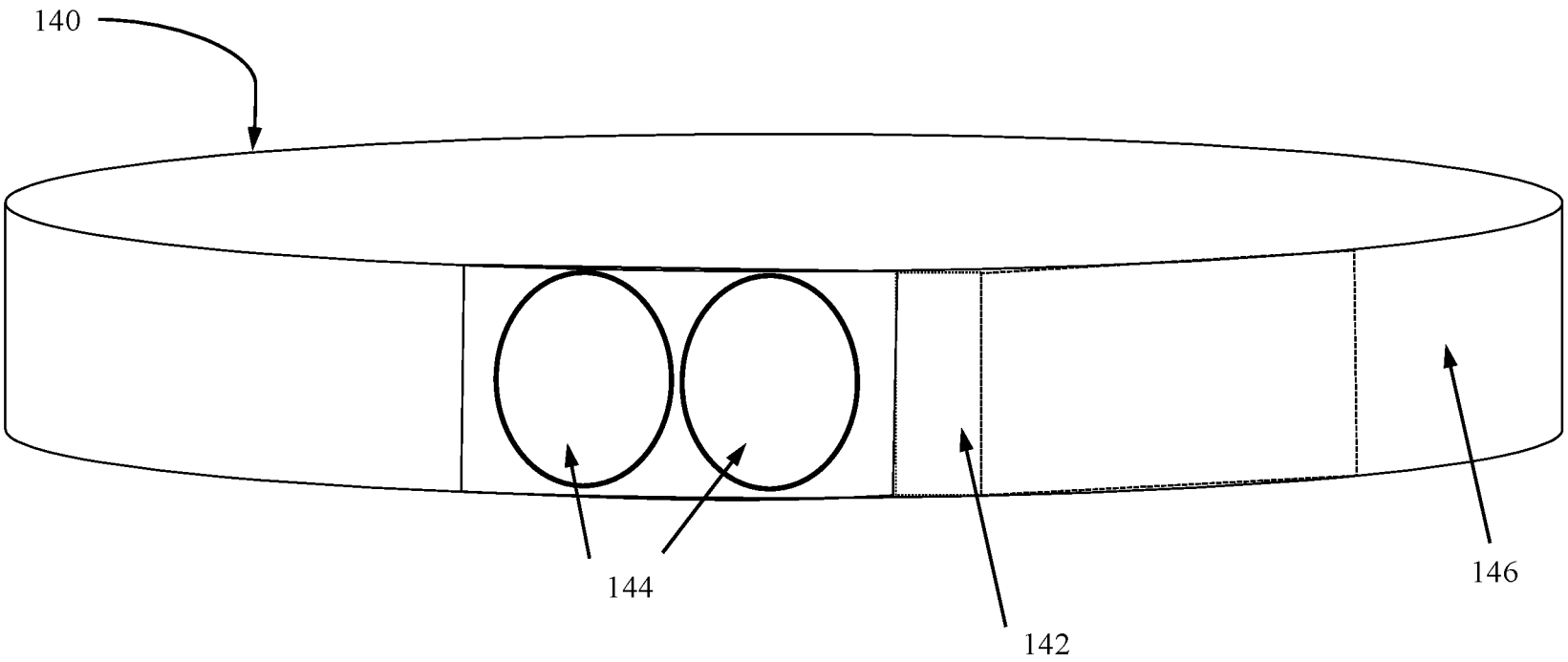
FIG. 5B is a side view of the layer of the multi-tool device shown in FIG. 5A having the slider door in an opened position and revealing input/output ports, according to one embodiment.

FIG. 5A is a side view of a layer 140 of a multi-tool device (e.g., device 10 or 18). In this layer 140, an embodiment of a slider door 142 is illustrated in a closed position. FIG. 5B is a side view of the layer 140 having the slider door 142 shown in its opened position to reveal storage ports/compartments 144 according to one embodiment. In this embodiment, the slider door 142 may be moved by pressing down slightly on the door 142 and sliding the door to one side. In some embodiments, the slider door 142 may be configured to slide underneath the circumferential cover 146 of the layer 140. According to alternative embodiments, the door 142 could be held closed by a push-latch mechanism, a magnet, a ball-catch mechanism, or any combination of these. The storage port/compartment or ports/compartments can be customized to fit one or more chosen items and/or tools such as a driver bit set, a socket driver with interchangeable bit set, a pen or pencil, straight knife blade, folding knife, razor blade, bottle opener, pliers, wrench, scissors, laser pointer, USB flash drive, SD or Micro SD card, miniature cell phone, MP3 player, audio recorder, linear or bull's-eye bubble level, cigar punch/cutter/piercer, ash tray, cork screw, cork remover, lighter, nail file, nail clipper, magnifying glass, jeweler's loupe, binoculars, monocular, currency bills or coins, credit cards, fitness/wellness ring or other fitness/wellness tracker, GPS tracker, fold-up or roll-up ruler/scale, rubber band, zip tie, steel cable, rope, note pad, map, photograph, information card with critical health or contact data about the user, wireless ear buds, wired ear buds, USB charging cable, pills, breath mints, or gum, small container of cologne/perfume, car key, car key fob, key, spare foldable or small eye glasses, spare foldable or small sunglasses, small multi-tool, first aid kit, flashlight, whistle, compass, non-rechargeable spare batteries, rechargeable spare batteries, garage door opener.

Figure 5C:
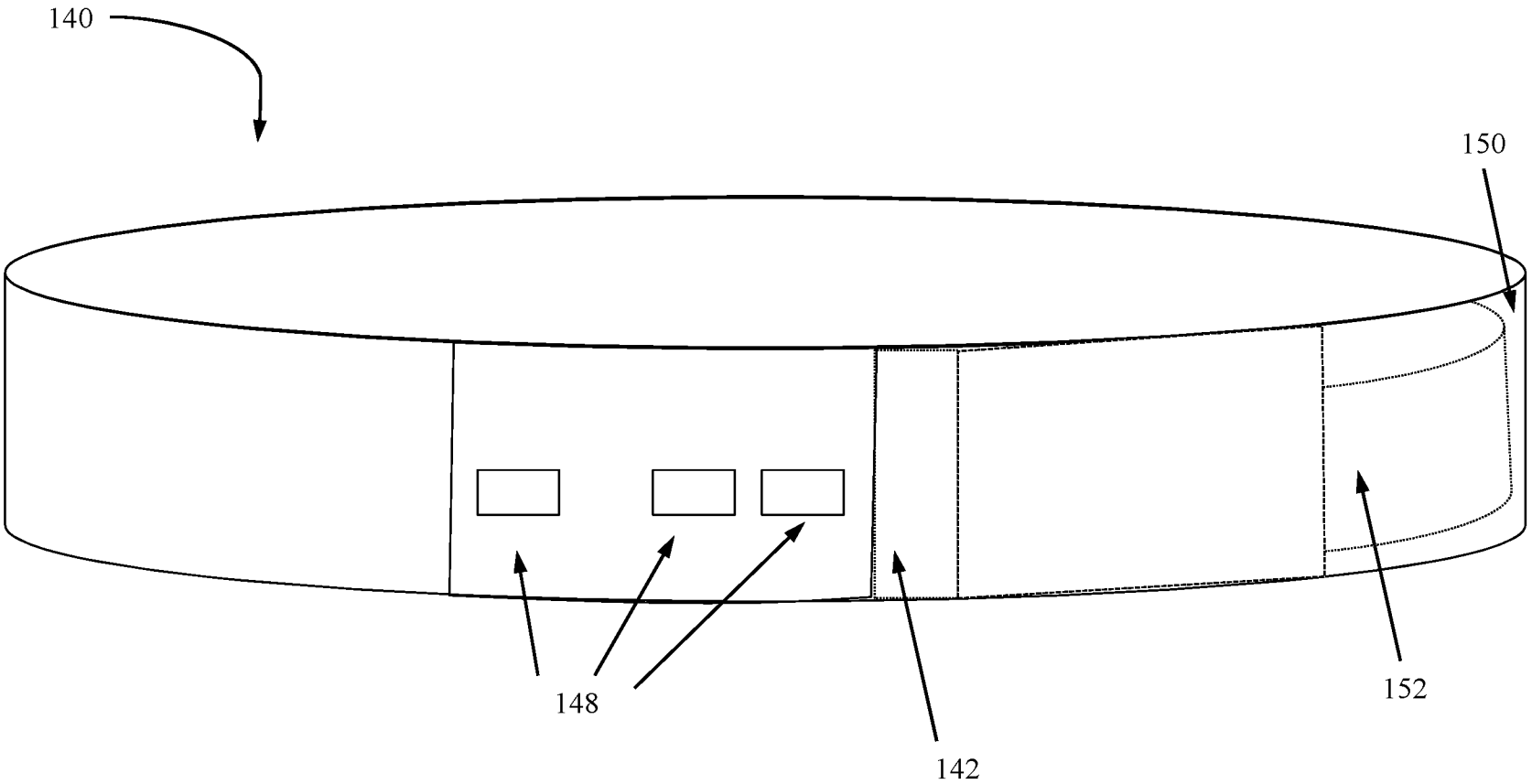
FIG. 5C is a side view of the layer of the multi-tool device shown in FIG. 5A having the slider door in an opened position and revealing USB ports, according to one embodiment.

FIG. 5C is a side view of the layer 140 of the multi-tool device 10, 18 shown in FIG. 5A. However, in this drawing, the slider door 142 is shown in an opened position, in this embodiment, to reveal USB ports 148, which may include input ports, output ports, combined input/output ports, charging ports, etc., such as USB, USB-C. In addition, the slider door 142 may further reveal a storage area 150 that is configured to store a rechargeable battery pack 152.

In the embodiment of FIG. 5C, the rechargeable battery pack 152 may be a rechargeable back-up battery/power bank, wherein the ports 148 may include input and/or output ports (e.g., USB ports) for connection with a charge cord. In some embodiments, the rechargeable battery pack 152 may be housed in the same layer of the device to provide power to the ports 148. In this case, a user can charge up a mobile phone or other device as needed, even when the user does not have access to an electrical outlet. The charging cord can also be stored in the storage area 150.

Figure 5D:
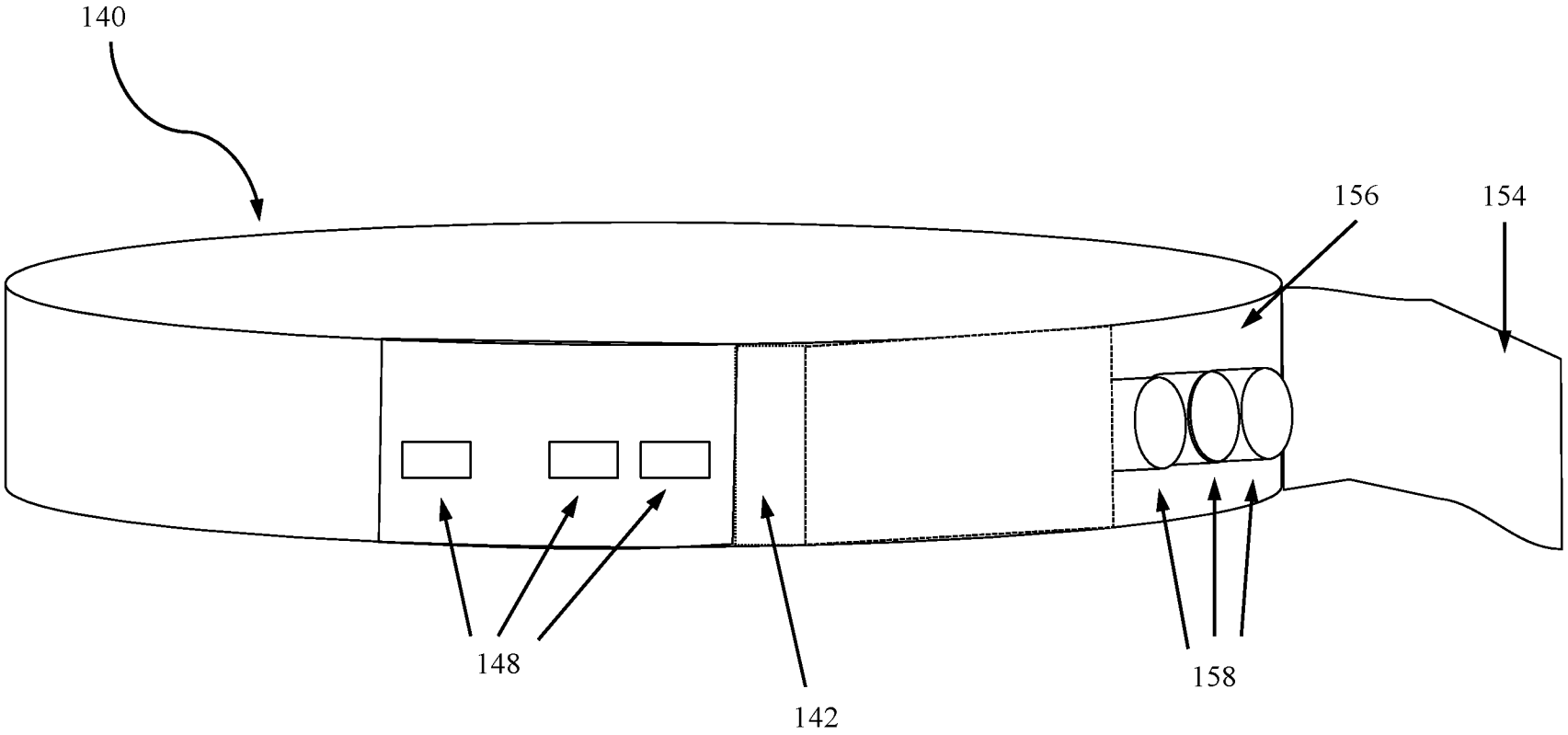
FIG. 5D is a side view of the layer of the multi-tool device shown in FIG. 5A having the slider door in an opened position and a second hinged door in an opened position revealing back-up batteries, according to one embodiment.

FIG. 5D is a side view of the layer 140 of the multi-tool device 10, 18 shown in FIG. 5A having the slider door 142 in an opened position to reveal the USB ports 148 and having a second hinged door 154, shown in an opened position, to reveal a compartment 156 where back-up batteries 158 can be stored. For example, the batteries may include AA, AAA, or other types of batteries. In this case, a similar back-up battery/power bank may be used for back-up power as may be needed. The batteries 158 may be rechargeable or non-rechargeable type batteries (such as standard alkaline AAA or AA batteries).

Figure 5E:
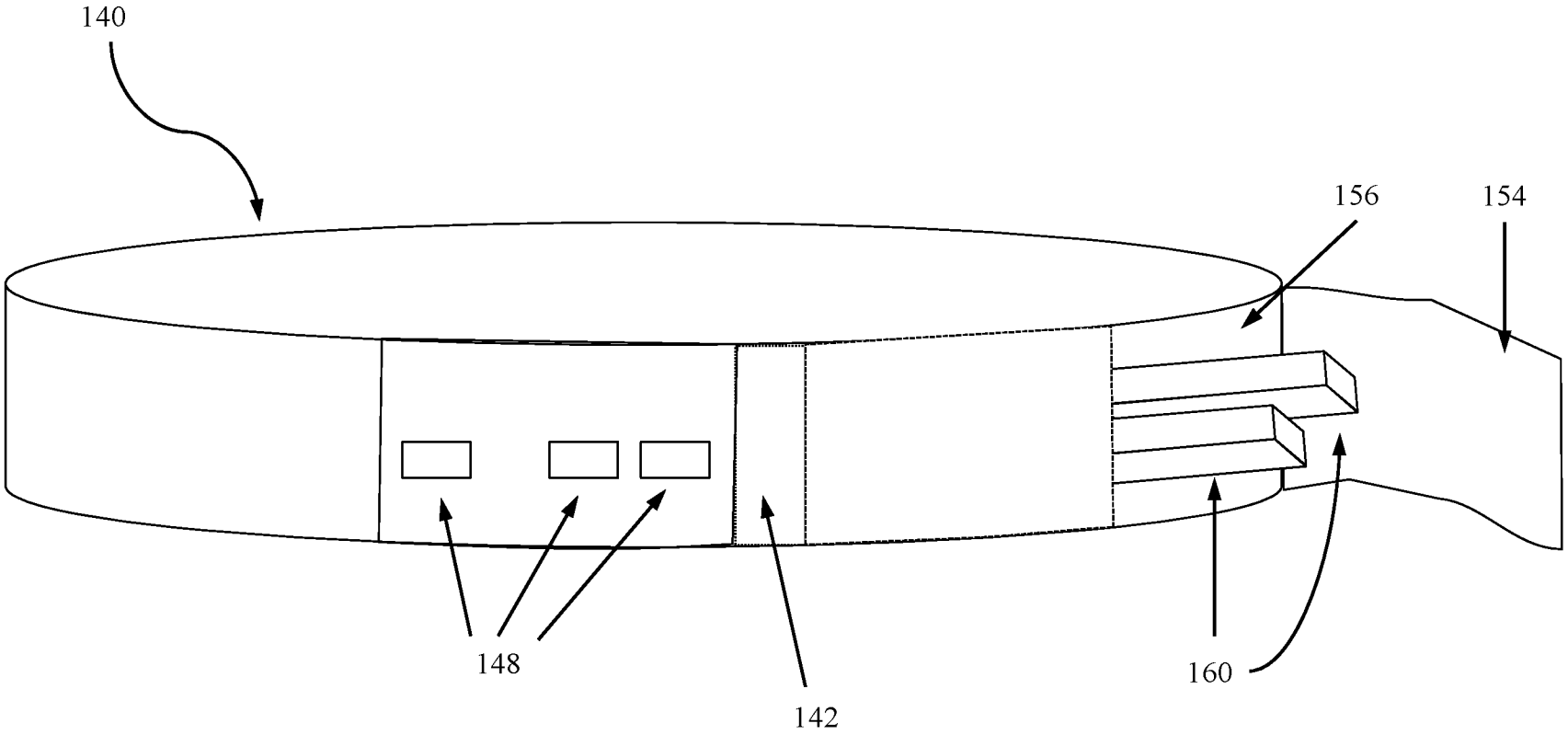
FIG. 5E is a side view of the layer of the multi-tool device shown in FIG. 5A having the slider door in an opened position and a second hinged door in an opened position revealing flash/thumb drives, according to one embodiment.

FIG. 5E is a side view of the layer 140 of the multi-tool device 10, 18 shown in FIG. 5A having the slider door 142 in an opened position and the second hinged door 154 shown in the opened position revealing flash/thumb/SD/micro SD drives 160 within the compartment 156. This layer 140 allows the device to accommodate either an integrated (large capacity) USB flash drive or compartments for small, portable USB flash drives (or SD cards, micro-SD, SIM cards, etc.). Data transfer cables (such as USB cables) can be stored within the compartment 156. Other items can be stored in this compartment 156 such as a driver bit set, a socket driver with interchangeable bit set, a pen or pencil, straight knife blade, folding knife, razor blade, bottle opener, pliers, wrench, scissors, laser pointer, USB flash drive, SD or Micro SD card, miniature cell phone, MP3 player, audio recorder, linear or bull's-eye bubble level, cigar punch/cutter/piercer, ash tray, cork screw, cork remover, lighter, nail file, nail clipper, magnifying glass, jeweler's loupe, binoculars, monocular, currency bills or coins, credit cards, fitness/wellness ring or other fitness/wellness tracker, GPS tracker, fold-up or roll-up ruler/scale, rubber band, zip tie, steel cable, rope, note pad, map, photograph, information card with critical health or contact data about the user, wireless ear buds, wired ear buds, USB charging cable, pills, breath mints, or gum, small container of cologne/perfume, car key, car key fob, key, spare foldable or small eye glasses, spare foldable or small sunglasses, small multi-tool, first aid kit, flashlight, whistle, compass, non-rechargeable spare batteries, rechargeable spare batteries, garage door opener.

Figure 6:
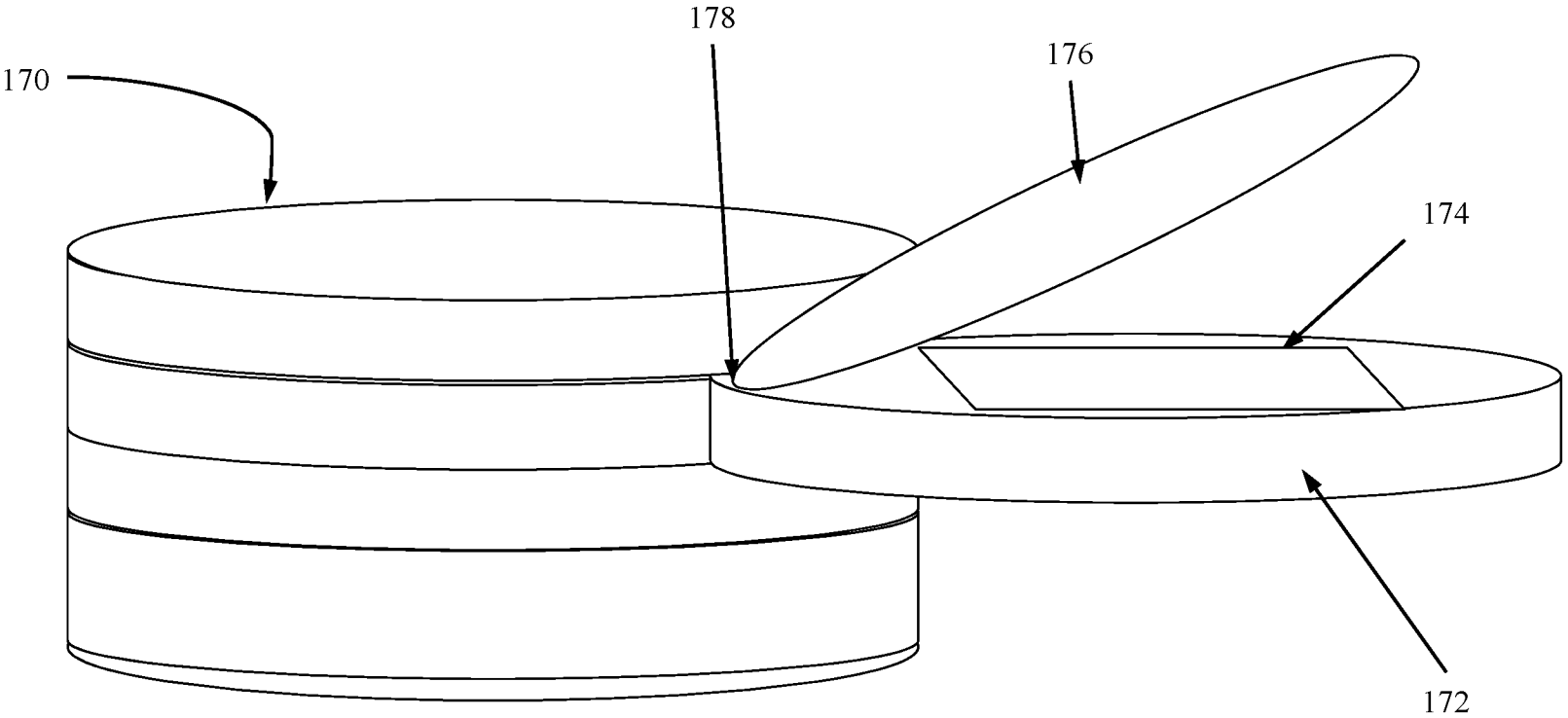
FIG. 6 is a side view of a multi-tool device having a layer with an accessible storage compartment, according to one embodiment.

FIG. 6 is a side view of an embodiment of a multi-tool device 170 having a layer 172 with an accessible storage compartment 174 with a lid 176 attached to the layer 172 by a lid that has a hinge 178 that is either spring-loaded or is free-moving so the user manually lifts it after the layer 172 is deployed. The layer 172 can be constructed so the lid/cover 176 automatically, by way of the spring-loaded hinge 178, opens upon the user deploying the layer 172. In one embodiment, the user can choose such a storage compartment 174 for storing an ultra-small cell phone safely and securely. Since there is a trend toward smaller cell phones as opposed to the very large screen cell phones, which are bulky and not comfortable to carry. Examples are small cell phones include The Light Phone, The Light Phone II, and the Zanco Tiny T1. Alternatively, one could store a very small two-way radio in this storage compartment 174.

According to other uses for the storage compartment 174, the user may wish to store other items therein and may customize the size and/or shape of the compartment 174 for specific uses. For example, the storage compartment 174 may be specifically designed and have the appropriate size to allow the user to store an ultra-compact digital camera, an ultra-compact MP3 player (with or without ear bud headphones), an ultra-compact digital voice recorder, and/or other items.

Another option that the user can choose is the dimensions of the compartment 174 for storing specific items. For example, the layer 172 may be configured to hold, fully concealed, credit cards and/or business cards. According to various embodiments, the layer could be either disc-shaped or ellipsoid-shaped due to the rectangular nature of current standard credit cards and business cards. The cards could fit in internal slots on the sides of the layer 172, which may be configured to grab the cards by friction. The cards could also be held in place by a push-latch mechanism, a magnet, a ball-catch mechanism, or any combination of these.

Additionally, in the embodiment of FIG. 6, the user could store other items, such as a driver bit set, a socket driver with interchangeable bit set, a pen or pencil, straight knife blade, folding knife, razor blade, bottle opener, pliers, wrench, scissors, laser pointer, USB flash drive, SD or Micro SD card, miniature cell phone, MP3 player, audio recorder, linear or bull's-eye bubble level, cigar punch/cutter/piercer, ash tray, cork screw, cork remover, lighter, nail file, nail clipper, magnifying glass, jeweler's loupe, binoculars, monocular, currency bills or coins, credit cards, fitness/wellness ring or other fitness/wellness tracker, GPS tracker, fold-up or roll-up ruler/scale, rubber band, zip tie, steel cable, rope, note pad, map, photograph, information card with critical health or contact data about the user, wireless ear buds, wired ear buds, USB charging cable, pills, breath mints, or gum, small container of cologne/perfume, car key, car key fob, key, spare foldable or small eye glasses, spare foldable or small sunglasses, small multi-tool, first aid kit, flashlight, whistle, compass, non-rechargeable spare batteries, rechargeable spare batteries, garage door opener.

Figure 7A:
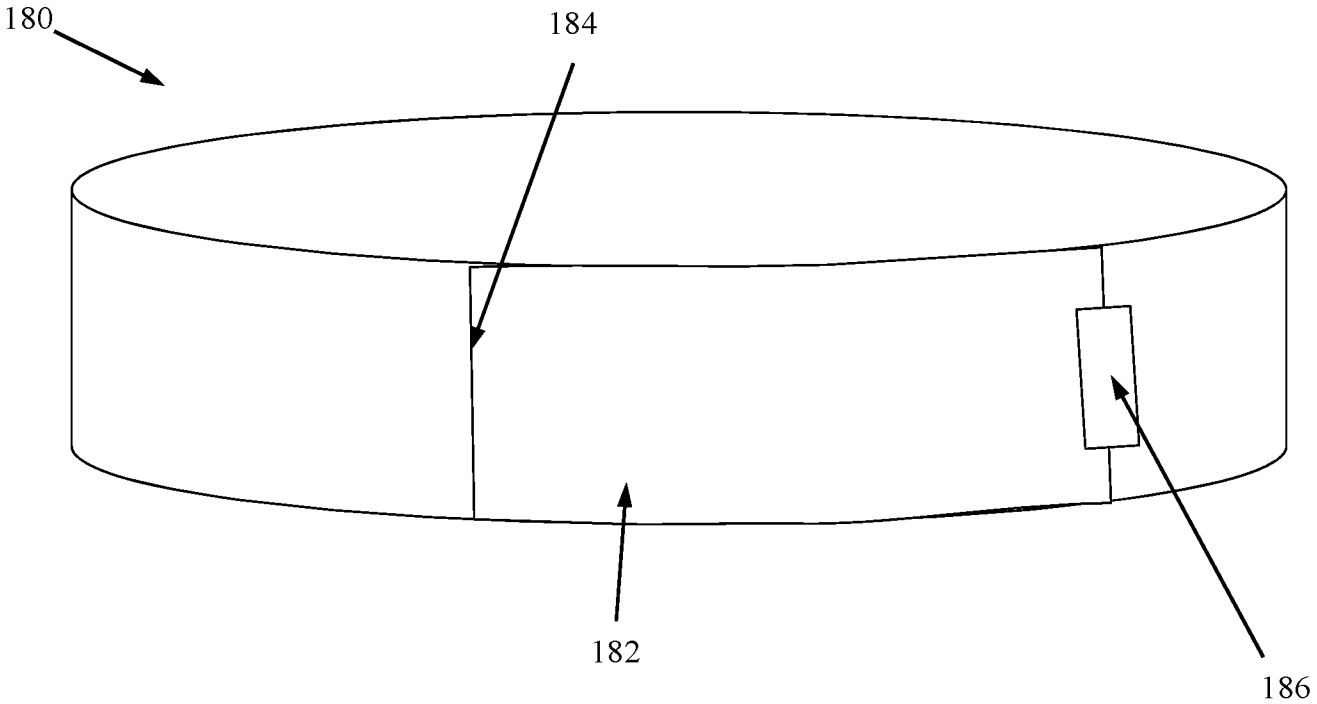
FIG. 7A is a side view of a layer of a multi-tool device having a hinged door in a closed position, according to one embodiment.

FIG. 7A is a side view showing an embodiment of a layer 180 of a multi-tool device (e.g., multi-tool device 10, 18). In this layer 180, a hinged door 182 is shown in a closed position. The hinged door 182 is connected to the layer 180 at a spring hinge 184. The door 182 can be opened by sliding a slide switch 186, which releases the door 182. Alternatively, the switch 186 could be a push-button switch that releases the door 182.

Figure 7B:
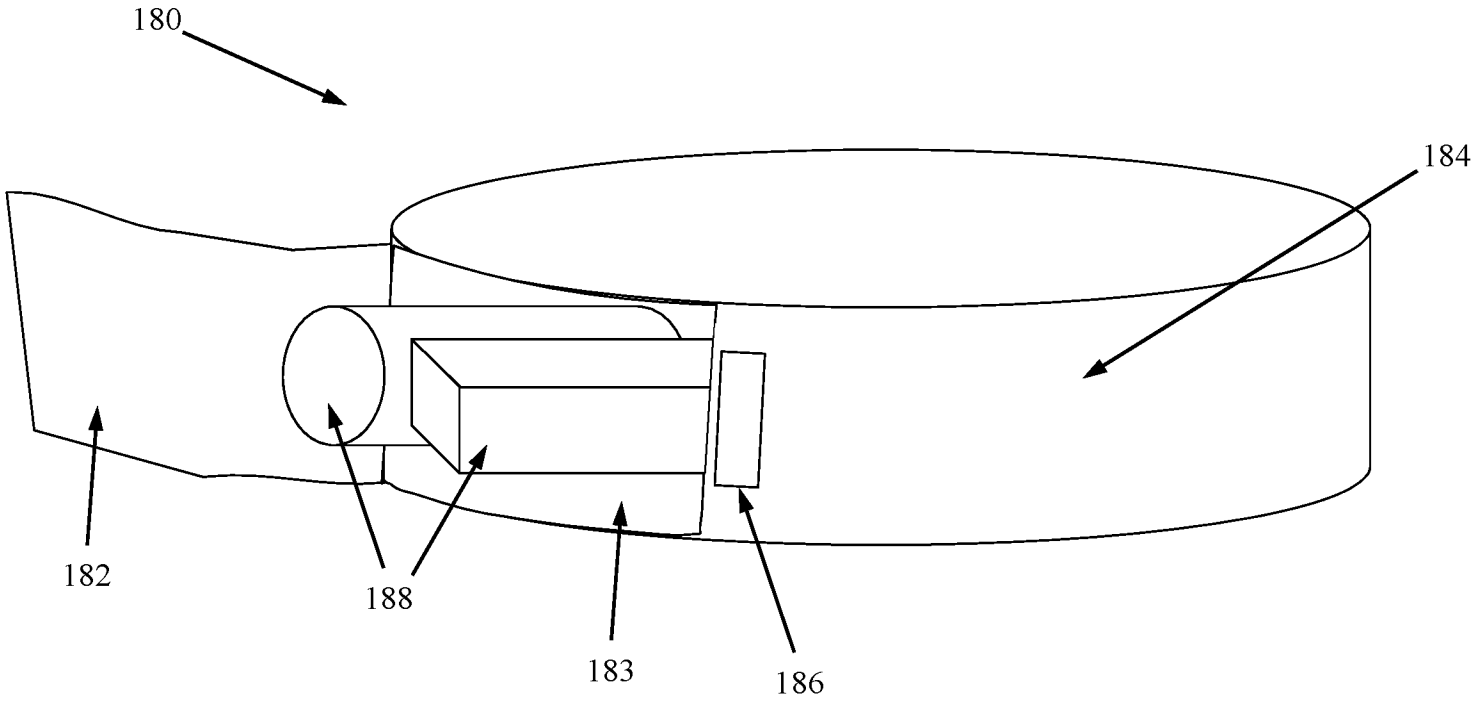
FIG. 7B is a side view of the layer of the multi-tool device shown in FIG. 7A having the hinged door in an opened position and revealing removable tools, according to one embodiment.

FIG. 7B is a side view of the layer 180 shown in FIG. 7A having the hinged door 182 in an opened position to reveal a storage port/compartment 183 in which the user can store removable tools or other items 188, such as a driver bit set, a socket driver with interchangeable bit set, a pen or pencil, straight knife blade, folding knife, razor blade, bottle opener, pliers, wrench, scissors, laser pointer, USB flash drive, SD or Micro SD card, miniature cell phone, MP3 player, audio recorder, linear or bull's-eye bubble level, cigar punch/ cutter/piercer, ash tray, cork screw, cork remover, lighter, nail file, nail clipper, magnifying glass, jeweler's loupe, binoculars, monocular, currency bills or coins, credit cards, fitness/wellness ring or other fitness/wellness tracker, GPS tracker, fold-up or roll-up ruler/scale, rubber band, zip tie, steel cable, rope, note pad, map, photograph, information card with critical health or contact data about the user, wireless ear buds, wired ear buds, USB charging cable, pills, breath mints, or gum, small container of cologne/perfume, car key, car key fob, key, spare foldable or small eye glasses, spare foldable or small sunglasses, small multi-tool, first aid kit, flashlight, whistle, compass, non-rechargeable spare batteries, rechargeable spare batteries, garage door opener.

Figure 7C:
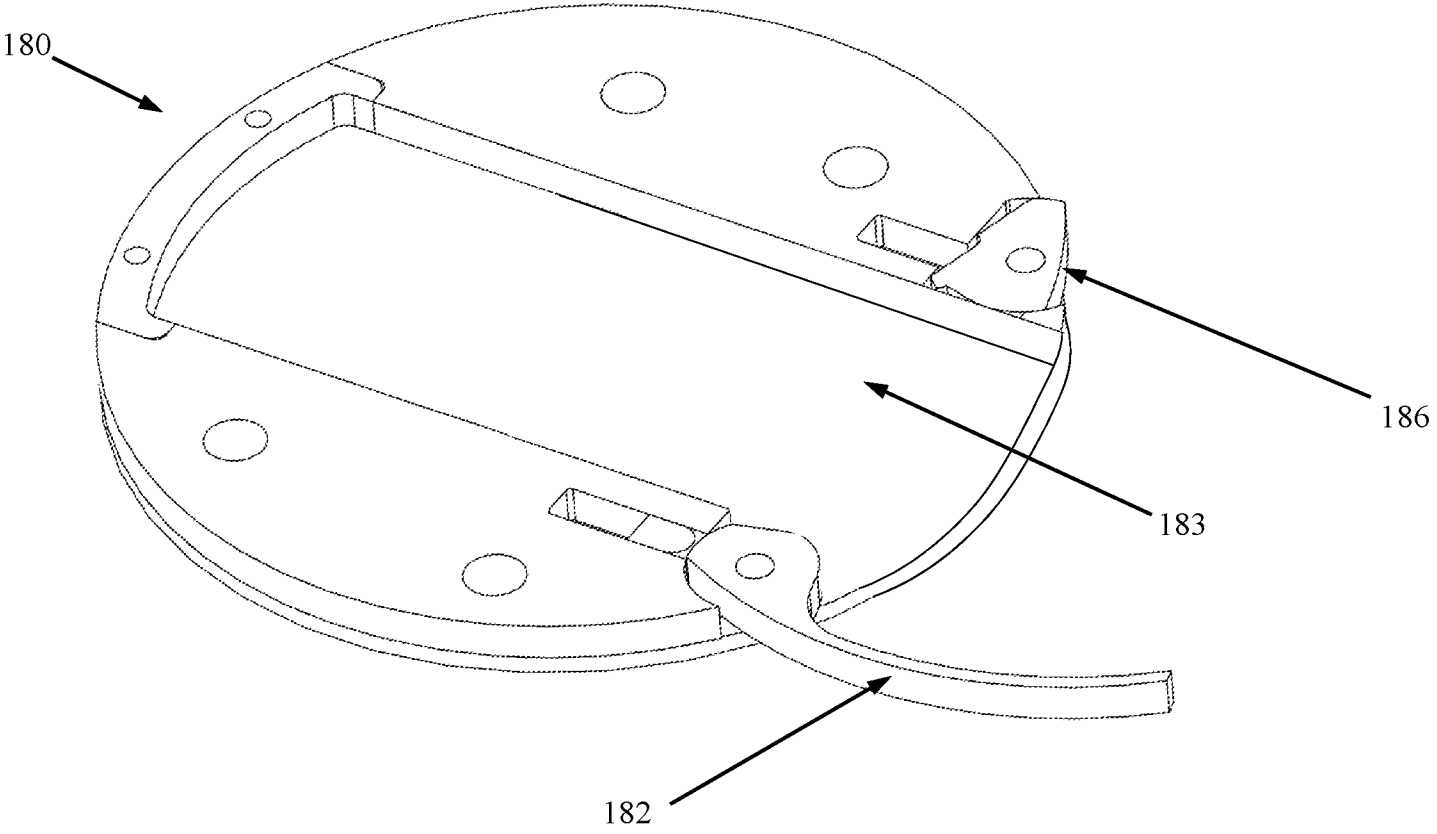
FIG. 7C is an axonometric view of the layer of the multi-tool device shown in FIG. 7A showing internal details of swing door and release button.
Figure 8A:
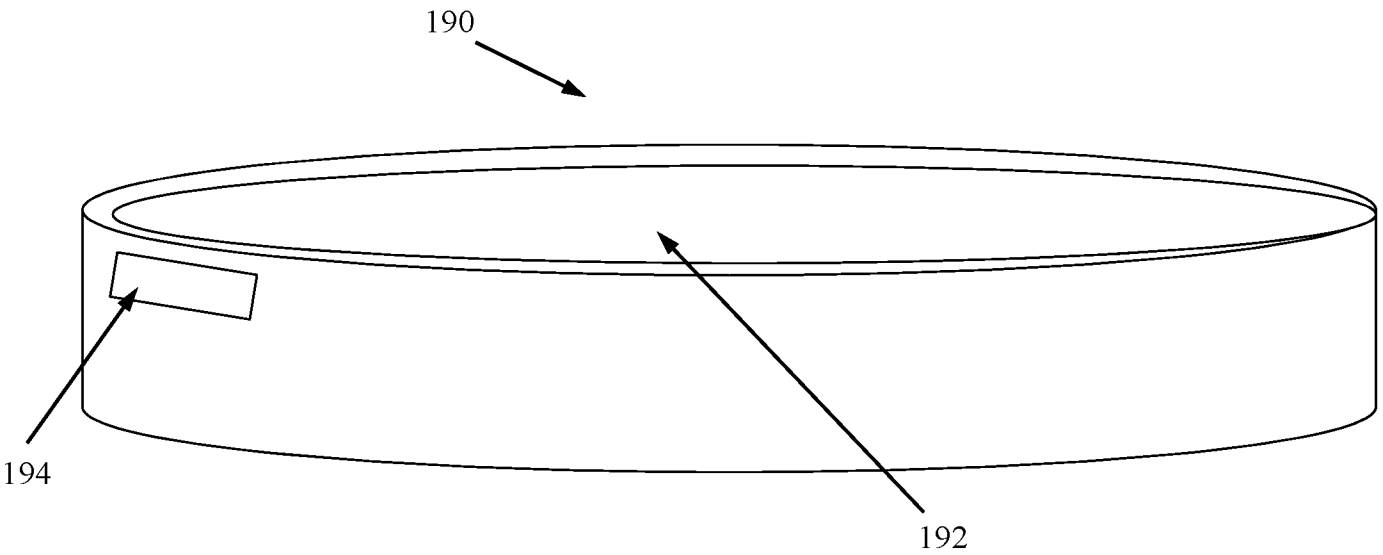
FIG. 8A is a side view of a top layer of a multi-tool device having a hinged lid in a closed position, according to one embodiment.
Figure 8B:
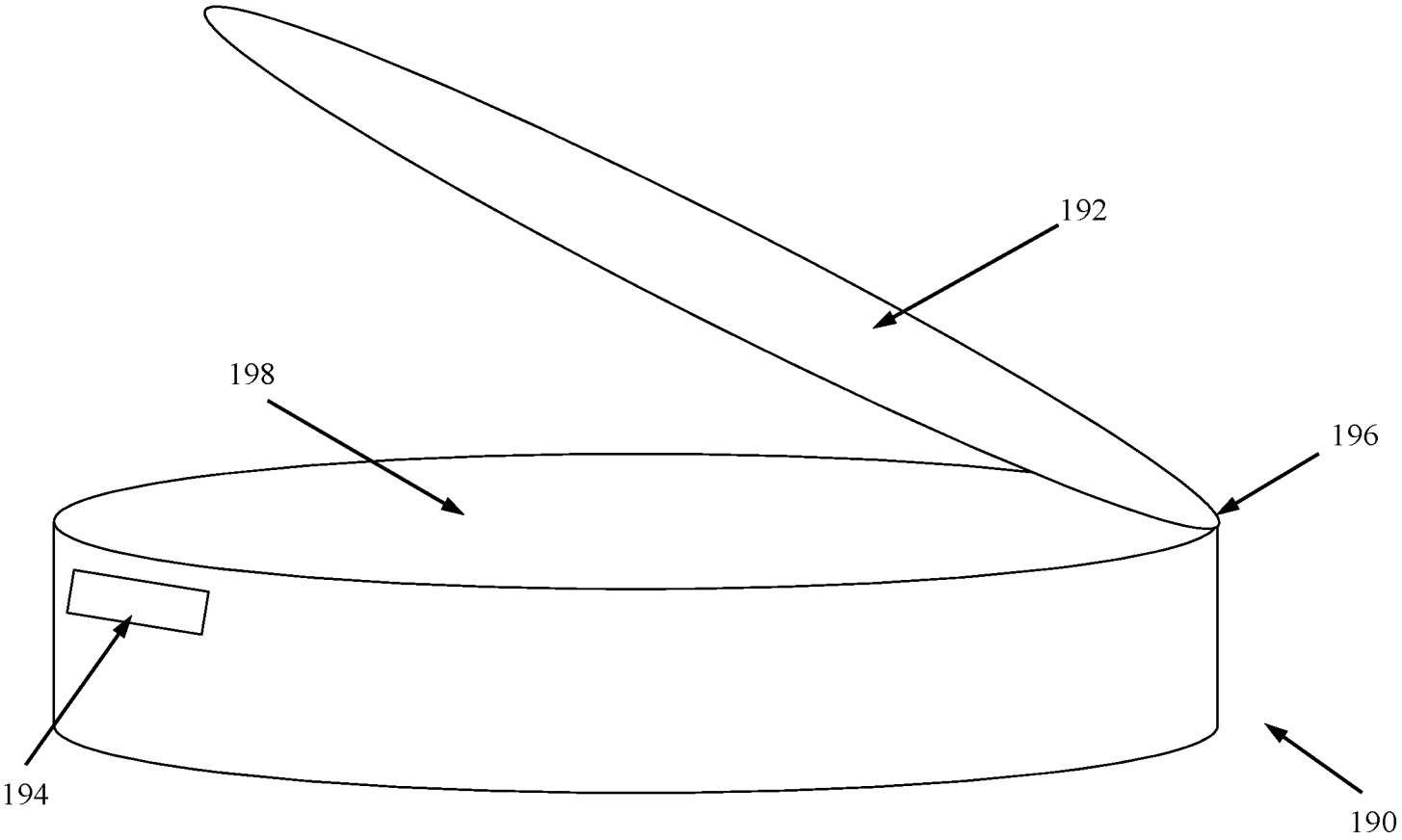
FIG. 8B is a side view of the top layer of the multi-tool device shown in FIG. 8A having the hinged lid in an opened position.

The door 182 can also be held closed by a push-latch mechanism, a magnet, a ball-catch mechanism, or any combination of these. FIG. 7C is an axonometric view of the layer 180 shown in FIG. 7A, showing details of the hinged door 182, the slide/release switch/button 186, and the storage compartment/port 183. FIG. 8A is a side view of a top layer 190 of a multi-tool device having a hinged lid 192, shown in a closed position, according to one embodiment. FIG. 8B shows the lid 192 in an opened position. To open the lid 192, a user presses a protruding circumferential switch 194 to release a spring-loaded feature of the lid 192, allowing the lid 192 to pivot at a hinge 196. The lid 196 may be configured as a shell and may include suitable shape. In some embodiments, the lid 196 may be a transparent lens or crystal for allowing a user to see a compartment 198 within the top layer 190. For example, the top layer 190 may be configured to hold a watch or compass, or in other cases may have a storage area for storing other items such as a driver bit set, a socket driver with interchangeable bit set, a pen or pencil, straight knife blade, folding knife, razor blade, bottle opener, pliers, wrench, scissors, laser pointer, USB flash drive, SD or Micro SD card, miniature cell phone, MP3 player, audio recorder, linear or bull's-eye bubble level, cigar punch/cutter/piercer, ash tray, cork screw, cork remover, lighter, nail file, nail clipper, magnifying glass, jeweler's loupe, binoculars, monocular, currency bills or coins, credit cards, fitness/wellness ring or other fitness/wellness tracker, GPS tracker, fold-up or roll-up ruler/scale, rubber band, zip tie, steel cable, rope, note pad, map, photograph, information card with critical health or contact data about the user, wireless ear buds, wired ear buds, USB charging cable, pills, breath mints, or gum, small container of cologne/perfume, car key, car key fob, key, spare foldable or small eye glasses, spare foldable or small sunglasses, small multi-tool, first aid kit, flashlight, whistle, compass, non-rechargeable spare batteries, rechargeable spare batteries, garage door opener.

Figure 8C:
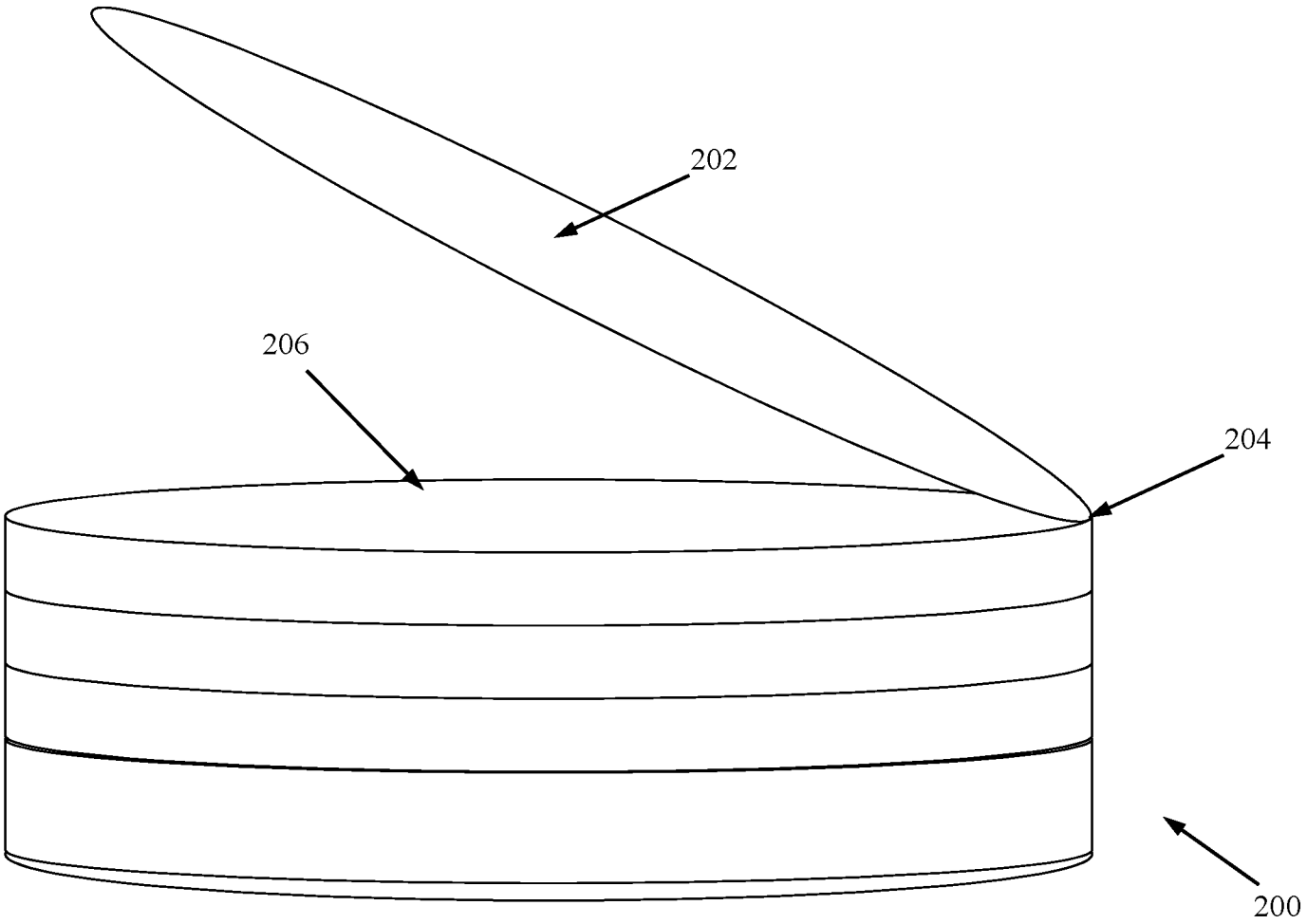
FIG. 8C is a side view of a multi-tool device having a hinged lid according to another embodiment in an opened position.

FIG. 8C is a side view of a multi-tool device 200 having multiple layers. In this embodiment, the multi-tool device 200 includes a hinged lid 202 shown in an opened position and connected to a top layer of the multi-tool device 200. The hinged lid 202 is connected to the top layer by a hinge 204 and may include a water-tight seal for preventing water or moisture from affecting any element under the lid 202. The hinged lid 202 may be shaped clear glass or a crystal shell to lock over the user's items stored in a water-tight compartment 206.

According to some embodiments, the customer may choose to have the top layer encapsulate a wristwatch face (i.e., without the band). The watch could be any type of watch, such as mechanical/automatic analog, quartz analog, traditional digital, an Apple watch or other smart watch, fitness tracker, calculator watch, etc.

Figure 9A:
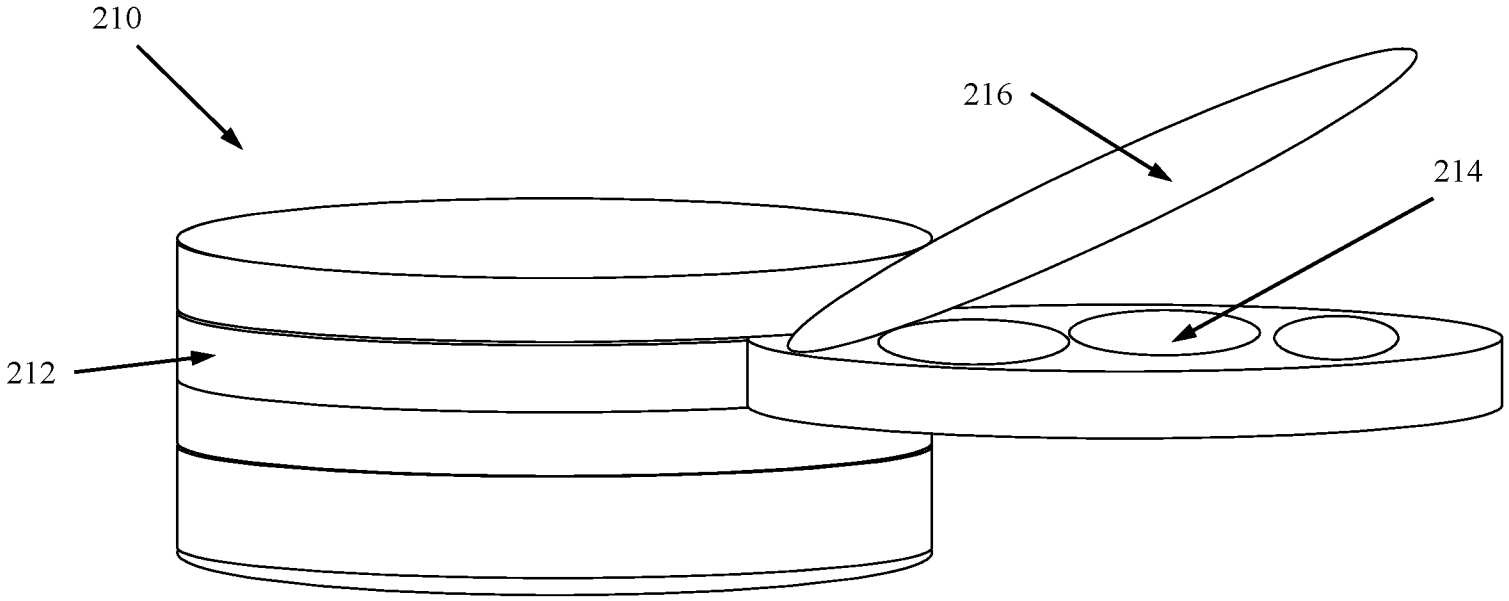
FIG. 9A is a side view of a layer of a multi-tool device having a storage compartment with a lid shown in an opened position, according to one embodiment.

FIG. 9A is a side view of a multi-tool device 210 having a layer 212 that includes a general-purpose storage compartment 214. In this embodiment, the compartment 214 may be covered with a hinged lid 216, which is shown in an opened position in FIG. 9A. The hinged lid 216 may be configured to open automatically when the moveable parts of the compartment 214 are pivoted away from the stationary parts of the layer 212, or the movable parts of the compartment could, in another embodiment, be deployed straight out from the stationary parts of the layer 212 either with a flick of the wrist or with a spring assist. This embodiment allows a user to select an option where a compartment can be incorporated in the multi-tool device 210 in a middle layer of the device as opposed to a top layer as mentioned above with respect to alternative embodiments.

Figure 9B:
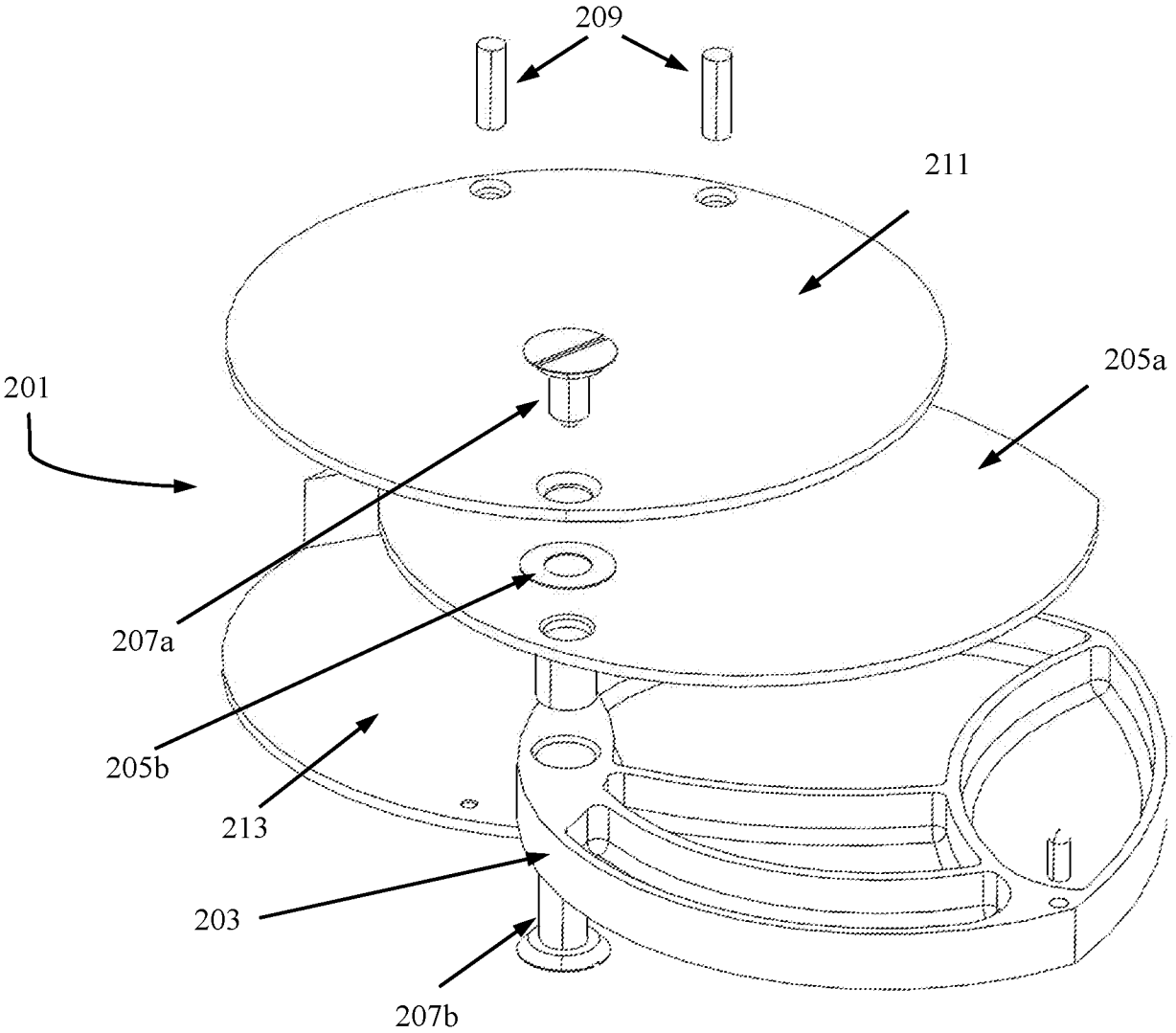
FIG. 9B is an exploded view of a swing-out storage case with a cover/lid, according to one embodiment.

The compartment 214 may include a pivoting action to allow a user to gain access to the contents stored in the compartment 214. For example, the compartment 214 may be a pill case for storing pills. The layer 212 could be held in a closed position by a push-latch mechanism, a magnet, a ball-catch mechanism, a spring-loaded switch, or any combination of these. The compartment 214 may be accessed by the user pressing a button, tab, or switch to release the compartment 214 or the user may manually pull the compartment 214 out from the body of the device 210. FIG. 9B is an exploded view of an embodiment layer 201 of a swing-out or pivot-out storage compartment 203, such as a pill storage case. It may include a pivot-away lid 205*a*, which is movable on a pivot such as a pin 207*b*, an incorporated washer 205*b* and a finish screw 207*a*. The swing out storage case 203 with its cover/lid 205*a* may be held in the stored position between a bottom plate 213 and a top plate 211 which are held together with a pin or pins or screw or screws such as 209. Other items could be stored in the storage compartment 203 such as a driver bit set, a socket driver with interchangeable bit set, a pen or pencil, straight knife blade, folding knife, razor blade, bottle opener, pliers, wrench, scissors, laser pointer, USB flash drive, SD or Micro SD card, miniature cell phone, MP3 player, audio recorder, linear or bull's-eye bubble level, cigar punch/cutter/piercer, ash tray, cork screw, cork remover, lighter, nail file, nail clipper, magnifying glass, jeweler's loupe, binoculars, monocular, currency bills or coins, credit cards, fitness/wellness ring or other fitness/wellness tracker, GPS tracker, fold-up or roll-up ruler/scale, rubber band, zip tie, steel cable, rope, note pad, map, photograph, information card with critical health or contact data about the user, wireless ear buds, wired ear buds, USB charging cable, pills, breath mints, or gum, small container of cologne/perfume, car key, car key fob, key, spare foldable or small eye glasses, spare foldable or small sunglasses, small multi-tool, first aid kit, flashlight, whistle, compass, non-rechargeable spare batteries, rechargeable spare batteries, garage door opener.

Figure 10A:
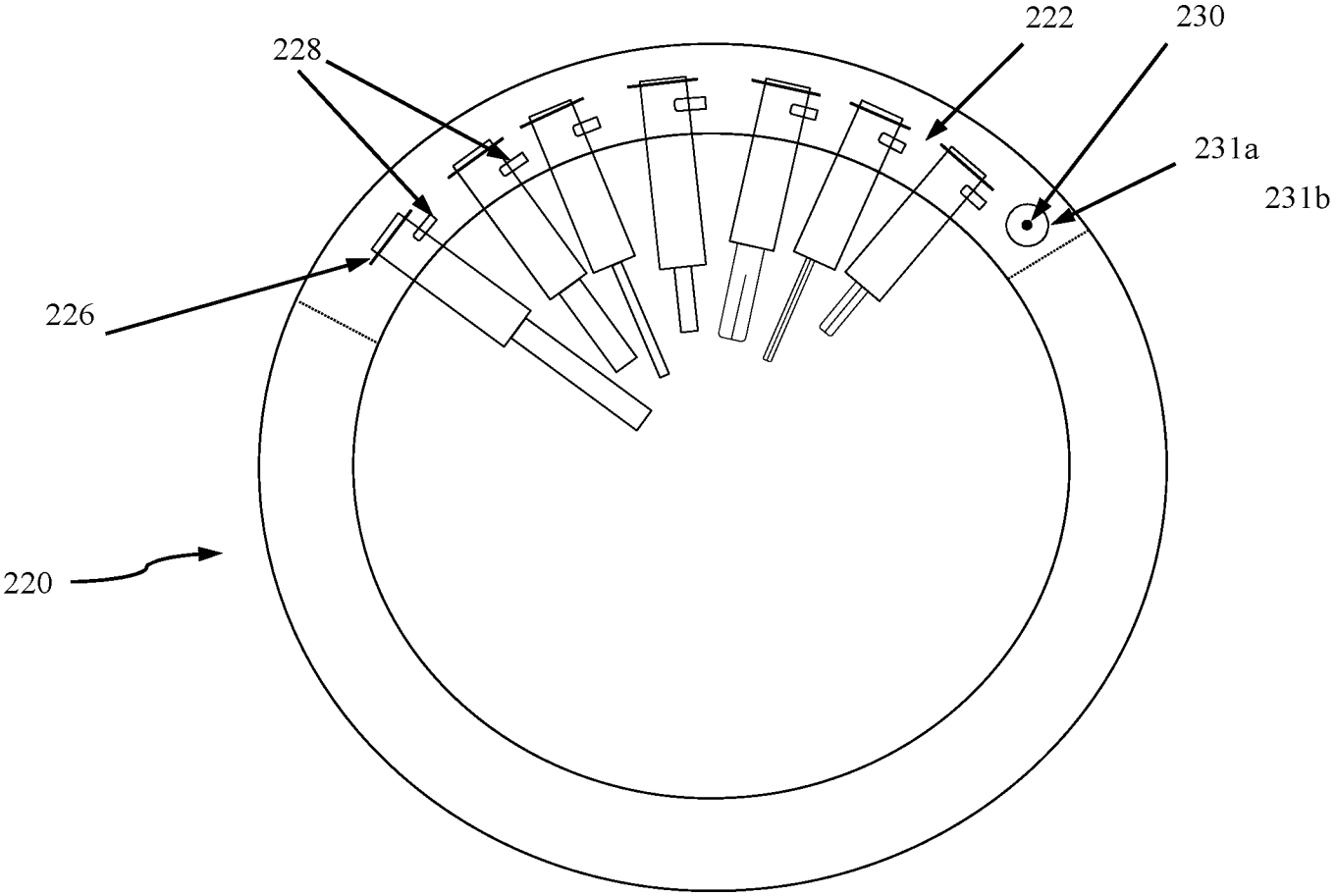
FIG. 10A is a top view of a layer of a multi-tool device having a hinged arm in a closed position, according to one embodiment.

FIG. 10A is a top view of an embodiment of a layer 220 of a multi-tool device having a hinged arm 222. In FIG. 10A, the hinged arm 222 is shown in a closed position and in FIG. 10B the hinged arm 222 is shown in an opened position. This layer 220 includes one or more spring-actuated tools 224. The one or more tools 224 may be deployed using spring-loaded hinge pins 226 that are released by slide release tabs 228.

Figure 10B:
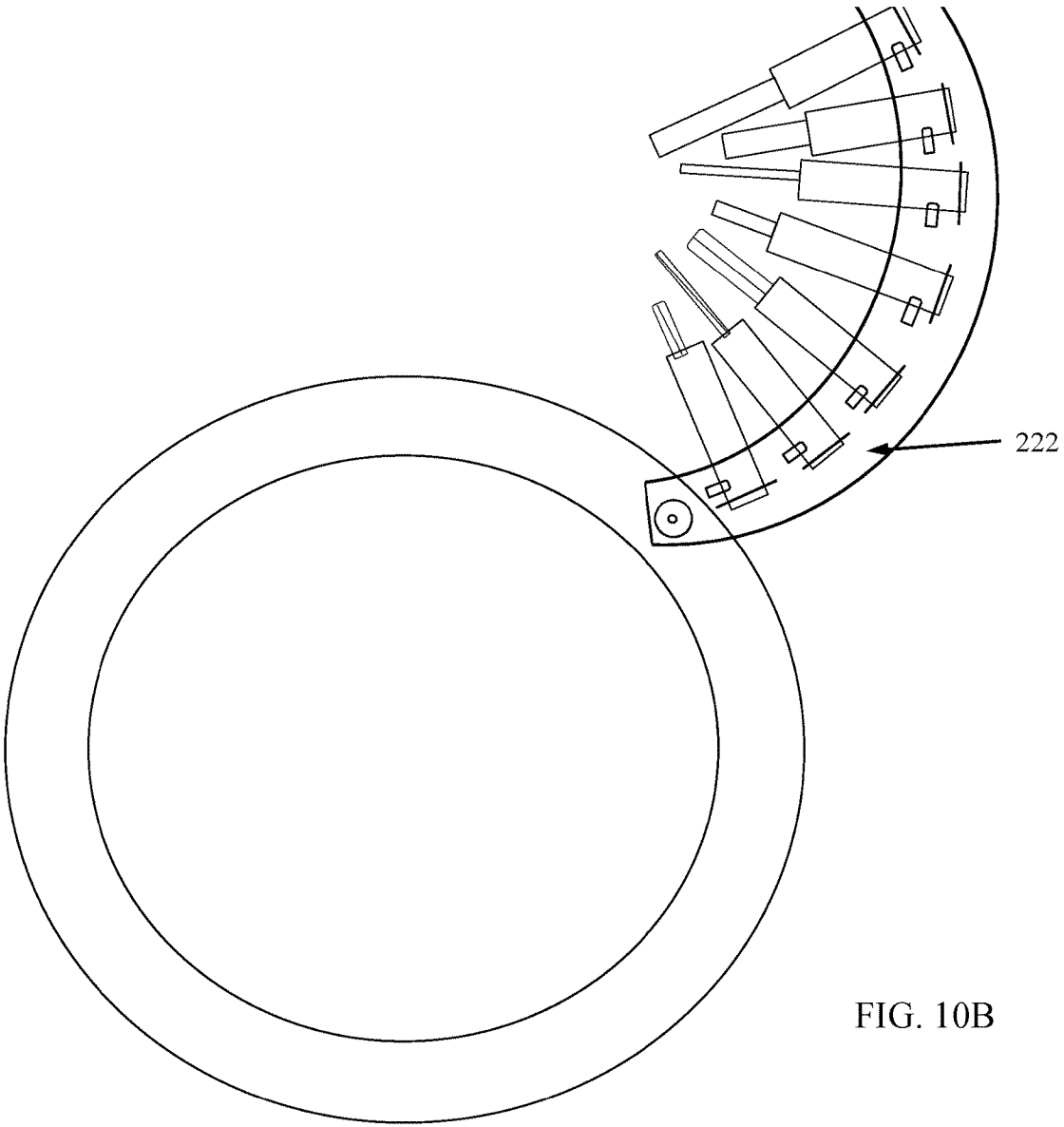
FIG. 10B is a top view of the layer of the multi-tool device of FIG. 10A having the hinged arm in an opened position to reveal a plurality of spring-actuated tools, according to one embodiment.
Figure 10C:
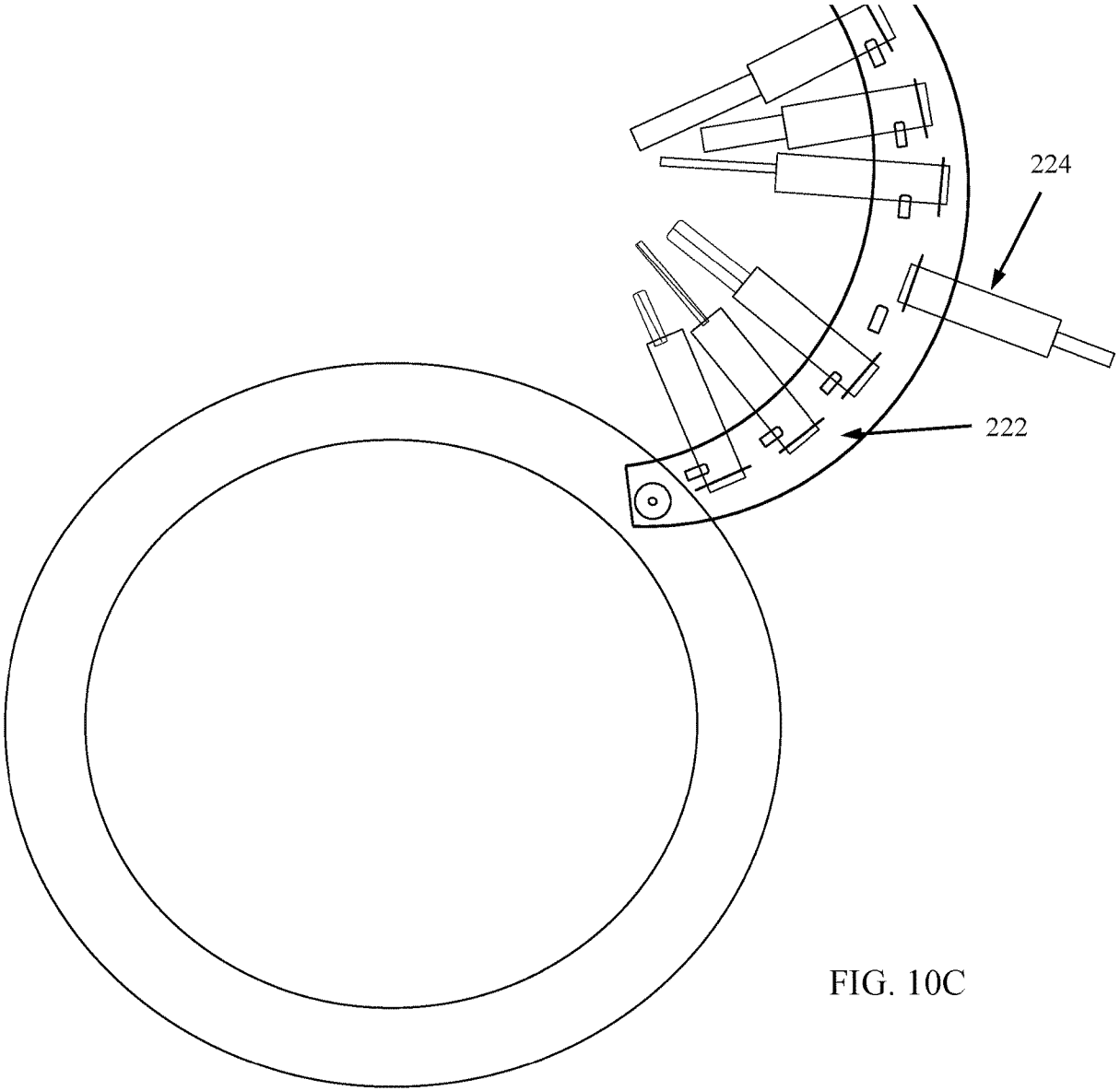
FIG. 10C is a top view of the multi-tool device of FIG. 10A having the hinged arm in an opened position and having one of a plurality of spring-actuated tools deployed into the position for use.

The hinged arm 222 is configured to support the tools 224 and the arm 222 may be pivoted about a spring-loaded hinge pin 230. By depressing a button 231*a* near or encompassing the spring-loaded hinge pin 230, the arm 222 is configured to swing out from the body of the housing to allow the user to have access to the multiple tools 224, as shown in FIG. 10B. The release button 231*b* could also be located on the side of the multi-tool layer. To select a tool 224 the user slides a slide release tab 228 which allows the spring-loaded tool to pivot out (along a plane perpendicular to the pivoting of the layer with respect to the whole device) to deploy the tool 224, as shown in FIG. 10C.

Figure 10D:
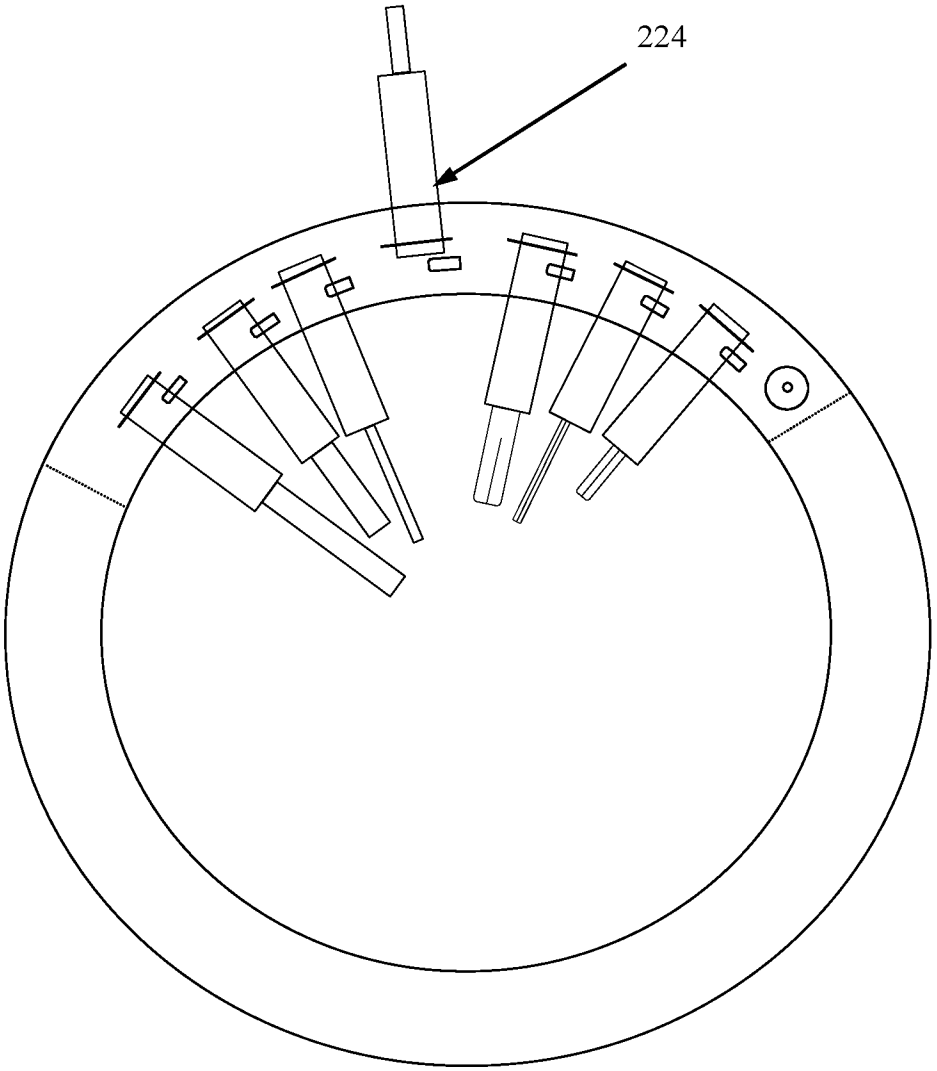
FIG. 10D is a top view of the multi-tool device of FIG. 10A having the hinged arm in the closed position and having the selected tool of FIG. 10C locked into the position for use.

Once a particular tool 224 is selected, user pivots the arm 222 back into the layer 220 of the device, as shown in FIG. 10D. The tool 224 is now locked into place for use by the user.

Figure 10E:
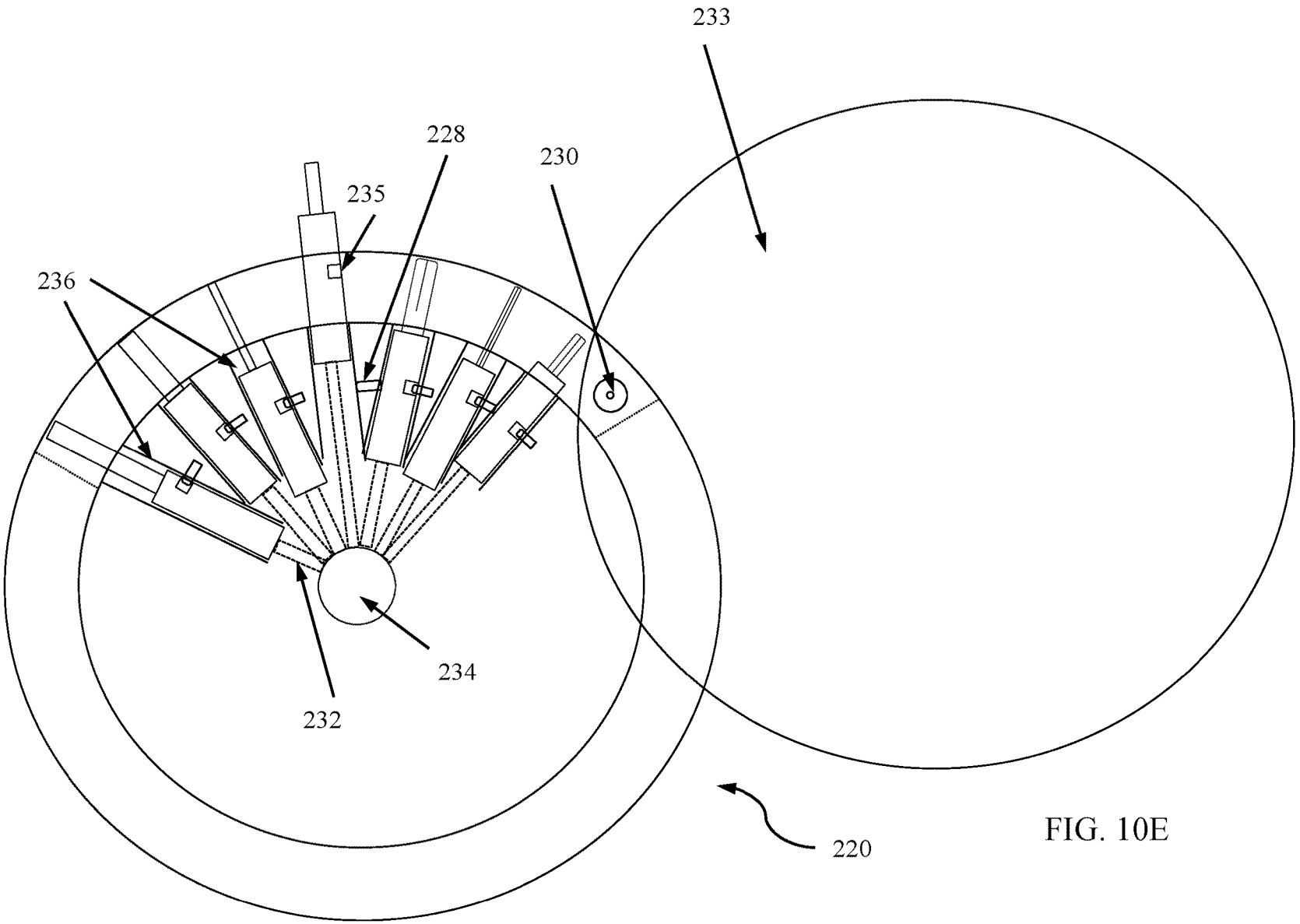
FIG. 10E is another embodiment of the multi-tool of FIG. 10A with the plurality of tools locked in place inside the body of the multi-tool device.

In alternative embodiments, shown in FIG. 10E, instead of an arm pivoting out, the cover 233 of the layer 220 may be pivoted around the pin 230 with respect to the stationary portions of the device. In these alternative embodiments, the tools 224 may be connected to one or more compression springs 232 connected to a hub 234. The tools 224 sit in channels just wide enough to let them freely slide in and out of the body 220 but fit snuggly to keep the tools 224 firmly set whether deployed or stored. The tools 224 in these embodiments have a notch in their body 235 into which the slide release tab 228 fits to hold the tool in place inside the body 220. When a selected tool 224 is to be used, the user slides the slide release tab 228 aside and the tool springs radially outward. At this point, the user can rotate the cover 233 back to the closed position or the user can use the tool 224 with the cover 233 in the open position. When finished, the tool 224 can be compressed back into the confines of the layer 220, where the slide release tab 228 will engage a notch 235.

Figure 10F:
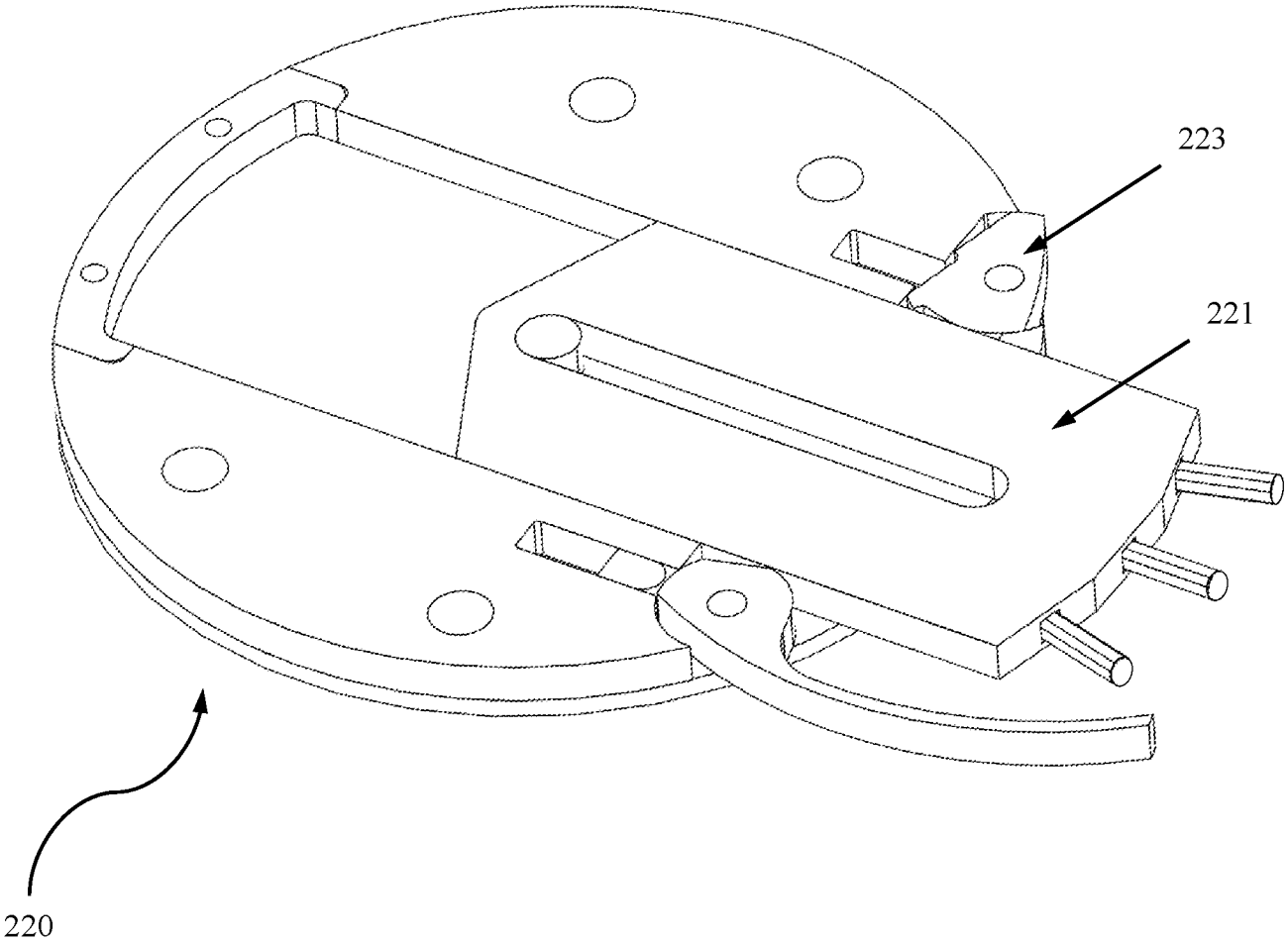
FIG. 10F is an axonometric view of an embodiment of the multi-tool of FIG. 10E with an example attached tool that can be locked in place inside the body of the multi-tool device.

FIG. 10F is a view of an embodiment of layer 220 wherein the user deploys the attached tool 221 by depressing a button 223. The attached tool 221 could be an object such as a driver set, bottle opener, a knife blade, socket driver with interchangeable bit set, pliers, wrench, cork screw, cork remover, scissors, cigar punch/cutter/piercer, lighter, nail file, magnifying glass, jeweler's loupe, binoculars, monocular, ash tray, laser pointer, flashlight, whistle, compass, cell phone stand/holder, cell phone, two-way radio, compass, ruler/scale, MP3 player, personal alarm, car key, car key fob, timepiece, fitness or wellness tracker, GPS tracker.

Figure 11:
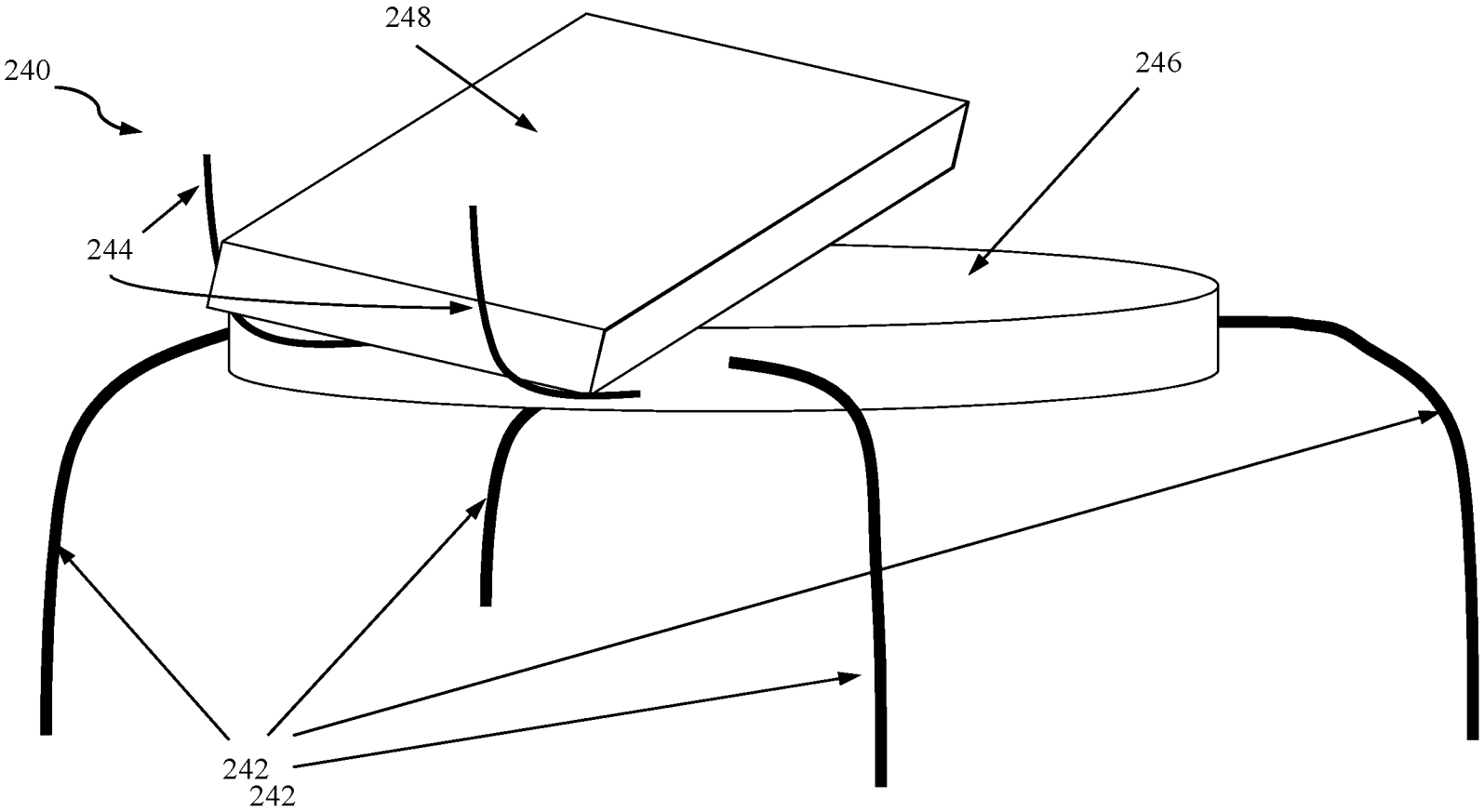
FIG. 11 is a side view of a stand/holder feature of a multi-tool device shown in a deployed state, according to one embodiment.

FIG. 11 is a side view of a stand/holder feature of a multi-tool device 240 shown in a deployed state. The user may be given the option to deploy legs 242 and/or a bracket 244 that would allow the entire housing to be supported. Preferably, the user may select a lower layer 246 of the multi-tool device to conceal the legs 242 or brackets 244, which can be deployed when needed to hold the device 240 in a certain position. Thus, the stand/holder feature allows the device 240 to serve as a holding device for holding a cell phone, camera, book, or other object 248, or for merely holding the device 240 away from a surface.

In some embodiments, the legs 242 and brackets 244 could be configured to hold a cigar or cigarette. The legs 242 and brackets 244 could configured to include components such as articulating multi-joint components and/or flexible-type components (e.g., stiff metal wire). In another embodiment, the device 240 may include a deployable tripod with compressive-spring components.

The cover layers or outer shells of the device hold many creative possibilities. The drawings show one where the user can choose to have one or both outer shells be a timepiece (e.g., a watch) that may have a shatterproof glass or crystal cover and stay revealed all the time, or alternatively could employ a spring-hinged cover, as in a traditional pocket watch.

Another outer shell option offered to the user would be a hinged clear glass or crystal cover that seals water-tight when closed. In the underlying compartment, the user could display a favorite watch (without the band) and this could be an analog watch, a digital watch, an Apple Watch, a calculator watch, or a fitness tracker. These devices could also be employed in a storage disk that is not one of the two outer shells.

An example of some of the tools that may be built into the device (as attached or removable) includes driver with fixed bit end, driver with socket pocket and separate bit set, pocketknives, letter openers, knives, tweezers, pliers, wrenches, hammers, scissors, nail clippers, nail files, pens, pencils, laser pointers, flashlights, screw drivers, toothpicks, cork screws, bottle opener, cigar cutters and punches/piercers, cigar holders/stands, ash trays, lighters, compact or foldable reading glasses, magnifying glass, GPS tracker, fitness/wellness ring or other small fitness/wellness tracker, first aid items and/or kits, small monoculars/binoculars/jeweler's loupes, small or foldable eyeglasses, small or foldable sunglasses, small eyeglass or sunglass repair kit, whistle or alarm, linear or bulls eye bubble/spirit level, navigation compass, fold-up or roll-up ruler or scale, coins, currency bills, notepad, map, photograph, information card with critical health and contact data about the user, just to name a few.

A multi-tool device comprising: a plurality of compartments, each compartment configured to house one or more attached tools, one or more removable tools, and/or one or more storage ports, each compartment including a moveable portion that is configured to be moveable with respect to the other portions; and at least one pin configured to connect the plurality of compartments together; wherein each of the moveable portions of the compartments is configured to move between a storage position and a deployed position; and wherein, when the moveable portions of the compartments are arranged in their respective storage positions, an outer surface of the multi-tool device has a disk shape, an ellipsoid shape, a truncated ellipsoid shape, a spheroid shape, a truncated spheroid shape, a sphere shape, or a truncated sphere shape.

The multi-tool device of claim 1, wherein the multi-tool device is a hand-held device. The multi-tool device of claim 1, further comprising a plurality of layers, wherein each layer is configured to house one or more compartments. The multi-tool device of claim 3, wherein an uppermost layer is configured with a hinge and cover lid. The multi-tool device of claim 4, wherein the tool in the uppermost layer is a watch and the cover lid is a crystal shell. The multi-tool device of claim 1, wherein at least one of the plurality of compartments comprises a fixed portion that remains stationary with respect to the other compartments.

The multi-tool device of claim 1, wherein at least one of the plurality of compartments comprises one or more buttons or switches configured to release the respective compartment from its storage position. The multi-tool device of claim 7, wherein, when a button or switch of a respective compartment is depressed, the compartment is configured to automatically move the moveable portion from its storage position to its deployed position. The multi-tool device of claim 8, further comprising one or more spring-assisted mechanisms configured for automatically moving the moveable portion from the storage position to the deployed position. The multi-tool device of claim 9, wherein the one or more spring-assisted mechanisms is further configured to move the moveable portion from the deployed position to the storage position.

The multi-tool device of claim 1, wherein one or more of the moveable portions includes a sliding door. The multi-tool device of claim 1, wherein the attached tools and removable tools include one or more devices selected from driver with fixed bit end, driver with socket pocket and separate bit set, pocketknives, letter openers, knife blades, fingernail clippers, fingernail files, tweezers, toothpicks, spare keys, car starter/fobs, cell phones, flash/thumb drives, money clips, change purses, corkscrews, bottle openers, pliers, wrenches, hammers, screw drivers, scissors, pens, pencils, laser pointers, pill cases, mint cases, flashlights, ash trays, lighters, cigar cutters, cigar punches/piercers, cigar holders/stands, reading glasses, magnifying glasses, small monoculars/binoculars/jeweler's loupes, small or foldable eyeglasses, small or foldable sunglasses, small eyeglass or sunglass repair kit, fold-up or roll-up ruler or scale, GPS trackers, fitness/wellness ring or other small fitness/wellness tracker, first aid kits whistle or alarm, linear or bulls eye bubble/spirit level, navigation compass, fold-up or roll-up ruler or scale, coins, currency bills, notepad, map, photograph, information card with critical health and contact data about the user. The multi-tool device of claim 1, wherein the one or more storage ports are configured to store one or more of non-rechargeable batteries, flash drives, thumb drives, mini-cell phones, mini-cameras, audio players, audio recorders, wireless ear bud speakers, wired ear bud speakers, fitness/wellness ring or other small fitness/wellness tracker, pills, breath mints, and gum. The multi-tool device of claim 1, further comprising a rechargeable back-up battery. The multi-tool device of claim 1, further comprising a USB port. The multi-tool device of claim 1, further comprising legs forming a tripod, stand, or holder.

Figure 12:
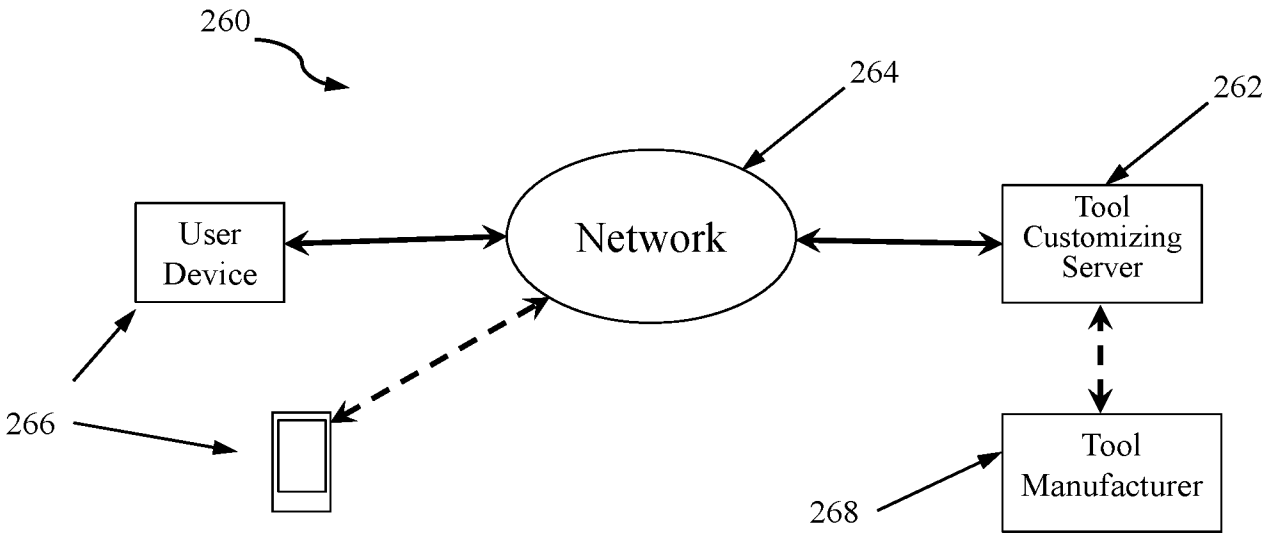
FIG. 12 is a block diagram of an embodiment of a multi-tool customizing system, according to one embodiment.

FIG. 12 is a block diagram of an embodiment of a multi-tool customizing system 260. In this embodiment, the system 260 includes a tool customizing server 262 that can be accessed via a network 264, such as the Internet. A user can access a website associated with the tool customizing server 262 using a user device 266, which may be a wired or wireless device that can communicate with the server 262 through the network 264.

The user can utilize a program on the tool customizing server 262 to select various options and design a multi-tool device as the user wishes. The server 262 may be configured to utilize three-dimensional software to ensure that various layers of the designed tool can be constructed as the user wishes, depending on the location of pivot pins and other elements that may extend from one layer to another. In some embodiments, the layers may be configured within their own separate areas and can be combined with any other layers without any possible interference with the other layers.

Once the tool has been designed and paid for, the tool customizing server 262 may be configured to send the specifications of the tool (e.g., selected tools, the layers where each tool is located, overall tool shape, finishing layer design, materials, etc.) to a tool manufacturer 268. The specifications may be transferred electronically or via a delivery service. At this point, the tool manufacturer 268 can construct the multi-tool device according to the user's specification and mail or deliver the device to the customer.

Figure 13:
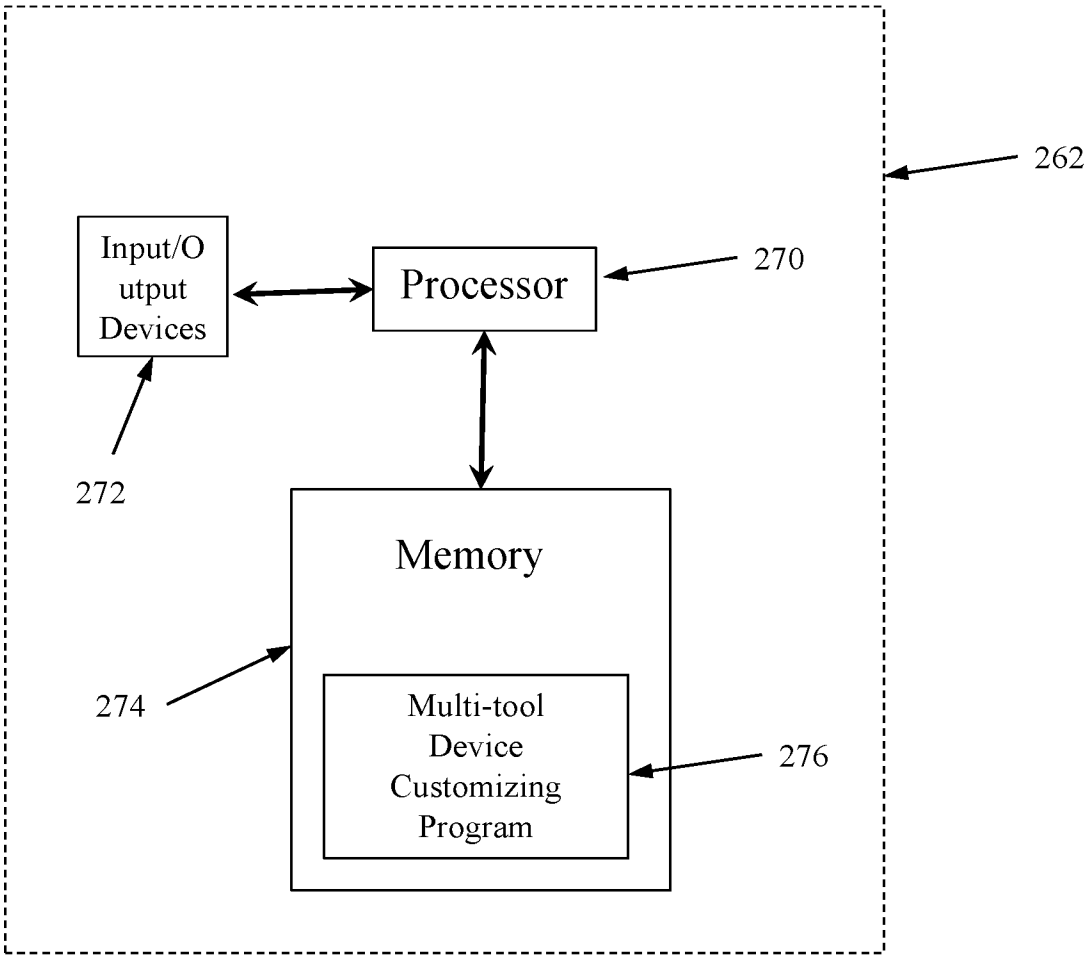
FIG. 13 is a block diagram of an embodiment of the tool customizing server shown in FIG. 12, according to one embodiment.

FIG. 13 is a block diagram of an embodiment of the tool customizing server 262 shown in FIG. 12. The tool customizing server 262 may include a processor 270, input/output devices 272, and memory 274. In some embodiments, the memory 274 may be configured to store a program, such as a multi-tool device customizing program 276, for enabling a user to customize the device. The multi-tool device customizing program 276 may include a number of screens that allow a user to navigate through various options to design the tool to his or her liking. The program 276 may also be configured to create a visual representation of what the tool looks like as it is being designed. The program 276 may also include a running cost that lets the user know how much the tool will cost if it is purchased with the selected options. The program 276 allows the user to add and remove options, tools, designs, shapes, and other features.

According to one embodiment, the program 276 may be configured on a non-transitory computer-readable medium (e.g., memory 274) of the network-based server 262 and is configured to enable the processor 270 to execute a number of software steps. In an exemplary embodiment, the non-transitory computer-readable medium enables the processor 270 to receive an order request from a user at a remote source, the order request including specifications for constructing a multi-tool device having a plurality of layers. The process 270, using the program, enables the user to select a plurality of tools to be combined into the multi-tool device to be constructed and enables the user to select a layer where each of the plurality of selected tools is to be housed. Each of the plurality of tools includes a moveable portion configured to move with respect to the other tools when the multi-tool device is constructed.

The program 276 stored in memory 274 and running on non-transitory computer-readable medium is further configured such that, when the moveable portions of the plurality of tools are arranged in their respective storage positions, the multi-tool device comprises a disk shape, ellipsoid shape, truncated ellipsoid shape, spheroid shape, truncated spheroid shape, sphere shape, or truncated sphere shape, ovoid shape or truncated ovoid shape. The program 276 further enables the processor 270 to let the user select a decorative outer cover of the multi-tool device.

What is claimed is:

1. A multi-tool device comprising:

a plurality of compartments, each compartment configured to house one or more attached tools, one or more removable tools, and/or one or more storage ports, each compartment including a moveable portion that is configured to be moveable with respect to the other portions; and at least one pin configured to connect the plurality of compartments together;

wherein each of the moveable portions of the compartments is configured to move between a storage position and a deployed position; and wherein, when the moveable portions of the compartments are arranged in their respective storage positions, an outer surface of the multi-tool device has a disk shape, an ellipsoid shape, a truncated ellipsoid shape, a spheroid shape, a truncated spheroid shape, a sphere shape, a truncated sphere shape, an ovoid shape or a truncated ovoid shape.

2. The multi-tool device of claim 1, wherein the multi-tool device is a hand-held device.

3. The multi-tool device of claim 1, further comprising a plurality of layers, wherein each layer is configured to house one or more compartments.

4. The multi-tool device of claim 3, wherein an uppermost layer is configured with a hinge and cover lid.

5. The multi-tool device of claim 4, wherein the tool in the uppermost layer is a watch and the cover lid is a crystal shell.

6. The multi-tool device of claim 1, wherein at least one of the plurality of compartments comprises a fixed portion that remains stationary with respect to the other compartments.

7. The multi-tool device of claim 1, wherein at least one of the plurality of compartments comprises one or more buttons or switches configured to release the respective compartment from its storage position.

8. The multi-tool device of claim 7, wherein, when a button or switch of a respective compartment is depressed, the compartment is configured to automatically move the moveable portion from its storage position to its deployed position.

9. The multi-tool device of claim 8, further comprising one or more spring-assisted mechanisms configured for automatically moving the moveable portion from the storage position to the deployed position.

10. The multi-tool device of claim 9, wherein the one or more spring-assisted mechanisms is further configured to move the moveable portion from the deployed position to the storage position.

11. The multi-tool device of claim 1, wherein one or more of the moveable portions includes a sliding door.

12. The multi-tool device of claim 1, wherein the attached tools and removable tools include one or more devices selected from driver with fixed bit end, driver with socket pocket and separate, stored collection of driver bits, letter openers, pocketknives, knife blades, fingernail clippers, fingernail files, tweezers, toothpicks, spare keys, car starter/fobs, cell phones, flash/thumb drives, money clips, change purses, corkscrews, bottle openers, pliers, wrenches, hammers, screw drivers, scissors, pens, pencils, laser pointers, pill cases, mint cases, flashlights, lighters, ash trays, cigar cutters, cigar punches/piercers, cigar holders/stands, reading glasses, magnifying glasses, small monoculars/binoculars/jeweler's loupes, small or foldable eyeglasses, small or foldable sunglasses, small eyeglass or sunglass repair kit, fold-up or roll-up ruler or scale , GPS trackers, fitness/wellness ring or other small fitness/wellness tracker, first aid kits whistle or alarm, linear or bulls eye bubble/spirit level, navigation compass, fold-up or roll-up ruler or scale, coins, currency bills, notepad, map, photograph, information card with critical health and contact data about the user.

13. The multi-tool device of claim 1, wherein the one or more storage ports are configured to store one or more of non-rechargeable batteries, flash drives, thumb drives, mini-cell phones, mini-cameras, audio players, audio recorders, wireless or wired ear ear bud speakers, fitness/wellness ring or other small fitness/wellness tracker, pills, breath mints, and gum.

14. The multi-tool device of claim 1, further comprising a rechargeable back-up battery.

15. The multi-tool device of claim 1, further comprising a USB port.

16. The multi-tool device of claim 1, further comprising legs forming a tripod, stand, or holder.

17. A non-transitory computer-readable medium of a network-based server configured to enable a processor to execute a number of software steps, the non-transitory computer-readable medium enabling the processor to:

receive an order request from a user at a remote source, the order request including specifications for constructing a multi-tool device having a plurality of layers;

enable the user to select a plurality of tools to be combined into the multi-tool device to be constructed; and enable the user to select a layer where each of the plurality of selected tools is to be housed;

wherein each of the plurality of tools includes a moveable portion configured to move with respect to the other tools when the multi-tool device is constructed.

18. The non-transitory computer-readable medium of claim 17, wherein, when the moveable portions of the plurality of tools are arranged in their respective storage positions, the multi-tool device comprises a disk shape, ellipsoid shape, truncated ellipsoid shape, spheroid shape, truncated spheroid shape, sphere shape, or truncated sphere shape, ovoid shape, or truncated ovoid shape.

19. The non-transitory computer-readable medium of claim 17, further enabling the processor to enable the user to select a decorative outer cover of the multi-tool device.

* * * * *